US005551588A

United States Patent [19]

Hills

[11] Patent Number: 5,551,588

[45] Date of Patent: Sep. 3, 1996

[54] PROFILED MULTI-COMPONENT FIBER FLOW PLATE METHOD

[75] Inventor: William H. Hills, Melbourne Village, Fla.

[73] Assignee: BASF Corporation, Parsippany, N.J.

[21] Appl. No.: 470,530

[22] Filed: Jun. 6, 1995

Related U.S. Application Data

[62] Division of Ser. No. 241,299, May 11, 1994, Pat. No. 5,466,410, which is a division of Ser. No. 893,286, Jun. 4, 1992, Pat. No. 5,344,297, which is a continuation-in-part of Ser. No. 354,259, Aug. 7, 1989, Pat. No. 5,162,074, which is a continuation of Ser. No. 103,594, Oct. 2, 1987, abandoned.

[51] Int. Cl.[6] ..... B44C 1/22

[52] U.S. Cl. ..... 216/56; 216/41

[58] Field of Search ..... 425/131.5; 156/644.1; 216/56, 39, 41

[56] References Cited

U.S. PATENT DOCUMENTS

| | | | |
|---|---|---|---|
| 1,654,936 | 1/1928 | Jones | 76/107.6 |
| 2,428,046 | 9/1947 | Sisson et al. | 428/370 |
| 2,628,417 | 2/1953 | Peyches | 216/56 |
| 2,815,532 | 12/1957 | Braunlich | 425/463 |

(List continued on next page.)

FOREIGN PATENT DOCUMENTS

| | | |
|---|---|---|
| 0058572 | 8/1982 | European Pat. Off. . |
| 0089735 | 9/1983 | European Pat. Off. . |
| 0104081 | 3/1984 | European Pat. Off. . |
| 88909182 | 5/1991 | European Pat. Off. . |
| 2429274 | 1/1980 | France . |
| 42-18561 | 9/1967 | Japan . |
| 43-7416 | 3/1968 | Japan . |
| 44-16171 | 7/1969 | Japan . |
| 46-41403 | 12/1971 | Japan . |
| 47-21242 | 6/1972 | Japan . |
| 47-31365 | 8/1972 | Japan . |
| 56-15417 | 2/1981 | Japan . |
| 56-144210 | 11/1981 | Japan . |
| 60-59122 | 4/1985 | Japan . |
| 60-162804 | 8/1985 | Japan . |
| 61-47808 | 3/1986 | Japan . |
| 61-97414 | 5/1986 | Japan . |
| 2057344 | 4/1981 | United Kingdom . |

OTHER PUBLICATIONS

*Metals Handbook*, 8th Ed., vol. 3, "Machining", American Society for Metals, pp. 240–249, 1967.

(List continued on next page.)

*Primary Examiner*—William Powell

[57] ABSTRACT

An apparatus for extruding a wide variety of plural-component and mixed monocomponent fiber configurations in a spin pack which utilizes one or more disposable distributor plates in which distribution flow paths are formed on one or both sides to distribute the polymer components to appropriate spinneret inlet hole locations. The etching process, itself inexpensive as compared to drilling, milling, reaming, etc., permits very thin metal plates to be employed, rendering the fabrication expense for the plates small, relative to the remainder of the spin pack, as to justify discarding or disposing of the plates rather than periodically cleaning them. The etching process also permits the etched distribution paths to be small and densely packed, whereby the spinneret orifices can be more densely packed in the spinneret and staggered as between rows and columns so as to increase the fiber yield per given spinneret surface area. The etching process also permits the distribution paths to be sufficiently small to facilitate issuing multiple discrete polymer component streams axially into each spinneret orifice inlet hole, whereby the resulting extruded fiber can be made up of at least one hundred side-by-side sub-fibers. If the adjacent sub-fibers are weakly bonded, they can be readily separated by agitation or dissolution to significantly increase the effective yield from the spin pack and provide very fine and uniform fibers. Importantly, these product advantages are achieved because of the etched disposable distribution plate which reduces initial and maintenance costs and is selectively replaceable to permit differently configured fibers to be fabricated from the same spin pack assembly.

1 Claim, 7 Drawing Sheets

U.S. PATENT DOCUMENTS

| | | | |
|---|---|---|---|
| 2,931,091 | 4/1960 | Breen | 428/370 |
| 2,936,482 | 5/1960 | Kilian | 425/463 |
| 2,989,798 | 6/1961 | Bannerman | 428/373 |
| 3,038,236 | 6/1962 | Breen | 428/224 |
| 3,039,174 | 6/1962 | Radow et al. | 428/374 |
| 3,117,362 | 1/1964 | Breen | 428/374 |
| 3,117,906 | 1/1964 | Tanner | 428/397 |
| 3,118,011 | 1/1964 | Breen | 264/168 |
| 3,176,345 | 4/1965 | Powell | 425/131.5 |
| 3,192,562 | 7/1965 | Powell | 425/131.5 |
| 3,204,290 | 9/1965 | Crompton | 425/190 |
| 3,237,245 | 3/1966 | Nonami et al. | 425/131.5 |
| 3,245,113 | 4/1966 | Sulich | 425/463 |
| 3,286,992 | 11/1966 | Armeniades et al. . | |
| 3,289,249 | 12/1966 | Nakayama et al. | 425/76 |
| 3,320,633 | 5/1967 | Cancio et al. | 425/463 |
| 3,344,472 | 10/1967 | Kitajima et al. | 425/131.5 |
| 3,418,200 | 12/1968 | Tanner | 428/373 |
| 3,423,261 | 1/1969 | Frantzen | 156/630 |
| 3,439,382 | 4/1969 | Sluijters | 425/463 |
| 3,458,615 | 7/1969 | Bragaw, Jr. et al. | 264/171 |
| 3,459,846 | 8/1969 | Matsui et al. | 264/171 |
| 3,492,692 | 2/1970 | Soda et al. | 425/131.5 |
| 3,501,805 | 3/1970 | Douglas, Jr. et al. | 425/131.5 |
| 3,531,368 | 9/1970 | Okamoto et al. | 428/374 |
| 3,538,544 | 11/1970 | Ullman | 425/131.5 |
| 3,540,080 | 11/1970 | Goossens | 425/131.5 |
| 3,584,339 | 6/1971 | Kamachi et al. | 425/131.5 |
| 3,585,685 | 6/1971 | McDermott | 425/131.5 |
| 3,601,846 | 8/1971 | Hudnall | 425/131.5 |
| 3,613,170 | 10/1971 | Soda et al. | 425/463 |
| 3,613,173 | 10/1971 | Matsui et al. | 425/462 |
| 3,659,988 | 5/1972 | Walczak | 425/131.5 |
| 3,672,802 | 6/1972 | Matsui et al. | 425/131.5 |
| 3,692,423 | 9/1972 | Okamoto et al. | 425/131.5 |
| 3,700,545 | 10/1972 | Matsui et al. | 428/374 |
| 3,718,534 | 2/1973 | Okamoto et al. | 428/374 |
| 3,730,662 | 5/1973 | Nunning | 425/131.5 |
| 3,773,882 | 11/1973 | Schrenk | 264/171 |
| 3,787,162 | 1/1974 | Cheetham | 425/463 |
| 3,807,917 | 4/1974 | Shimoda et al. | 425/131.5 |
| 3,814,561 | 6/1974 | Matsui et al. | 425/131.5 |
| 3,825,456 | 7/1974 | Weber et al. | 156/633 |
| 3,846,197 | 11/1974 | Wiley | 156/633 |
| 3,849,044 | 11/1974 | Ando et al. | 425/131.5 |
| 3,924,990 | 12/1075 | Schrenk | 425/131.1 |
| 3,963,406 | 6/1976 | Reker | 425/463 |
| 3,968,307 | 7/1976 | Matsui et al. | 428/373 |
| 4,052,146 | 10/1977 | Sternberg | 425/463 |
| 4,127,696 | 11/1978 | Okamoto | 428/373 |
| 4,189,338 | 2/1980 | Ejima et al. | 156/167 |
| 4,211,819 | 7/1980 | Kunimune et al. | 428/374 |
| 4,234,655 | 11/1980 | Kunimume et al. | 428/374 |
| 4,251,200 | 2/1981 | Parkin | 425/131.5 |
| 4,293,516 | 10/1981 | Parkin | 264/168 |
| 4,301,101 | 11/1981 | Bachmann et al. | 264/130 |
| 4,307,054 | 12/1981 | Chion et al. | 264/171 |
| 4,308,004 | 12/1981 | Chion et al. | 425/131.5 |
| 4,325,765 | 4/1982 | Yu et al. | 156/167 |
| 4,332,757 | 6/1982 | Blackmon et al. | 264/103 |
| 4,350,006 | 9/1982 | Okamoto et al. | 428/373 |
| 4,370,114 | 1/1983 | Okamoto et al. | 425/131.5 |
| 4,376,743 | 3/1983 | Dees | 264/103 |
| 4,381,274 | 4/1983 | Kessler et al. | 264/147 |
| 4,381,335 | 4/1983 | Okamoto | 428/373 |
| 4,383,817 | 5/1983 | Mirhej | 425/463 |
| 4,396,366 | 8/1983 | Kessler et al. | 425/131.5 |
| 4,406,850 | 9/1983 | Hills | 264/171 |
| 4,411,852 | 10/1983 | Bromley et al. | 264/171 |
| 4,414,276 | 11/1983 | Kiriyama et al. | 428/374 |
| 4,435,141 | 3/1984 | Weisner et al. | 425/131.1 |
| 4,439,487 | 3/1984 | Jennings | 428/397 |
| 4,445,833 | 5/1984 | Moriki et al. | 425/131.5 |
| 4,447,489 | 5/1984 | Linhart et al. | 428/225 |
| 4,451,420 | 5/1984 | Keuchel | 264/167 |
| 4,460,649 | 7/1984 | Park et al. | 428/373 |
| 4,469,540 | 9/1984 | Furukawa et al. | 156/62.4 |
| 4,470,941 | 9/1984 | Kurtz | 264/136 |
| 4,477,516 | 10/1984 | Sugihara et al. | 428/296 |
| 4,482,309 | 11/1984 | Bromley et al. | 425/131.5 |
| 4,500,384 | 2/1985 | Tomioka et al. | 156/290 |
| 4,546,043 | 10/1985 | Yoshimoto et al. | 428/397 |
| 4,547,420 | 10/1985 | Krueger et al. | 428/229 |
| 4,600,631 | 7/1986 | Alei et al. | 428/212 |
| 4,604,320 | 8/1986 | Okamoto et al. | 428/290 |
| 4,713,292 | 12/1987 | Takemura et al. | 428/373 |
| 4,717,325 | 1/1988 | Fujimura et al. | 425/131.5 |
| 4,717,487 | 1/1988 | Griffith et al. | 252/1 |
| 4,738,607 | 4/1988 | Nakajima et al. | 425/131.5 |
| 4,772,347 | 9/1988 | Fowler | 156/167 |

OTHER PUBLICATIONS

*Allen D. M., The Principles and Practice of Photochemical Machining and Photoetching*, 1986, Adam Hilger, Bristol, England.

Fitzgerald, W. E. and Knudsen, J. P., *Textile Research Journal*, vol. 37, No. 6, Jun. 1967, p. 447, "Mixed Stream Spinning Of Bicomponent Fibers".

PROFILED MULTI-COMPONENT FIBER FLOW PLATE METHOD

This is a divisional of application Ser. No. 08/241,299 filed on May 11, 1994, now U.S. Pat. No. 5,466,410, which is a divisional of 07/893,286, filed Jun. 4, 1992 (now U.S. Pat. No. 5,344,297, issued Sep. 6, 1994), which was a continuation-in-part of 07/354,259, filed Aug. 7, 1989 (now U.S. Pat. No. 5,162,074, issued Nov. 10, 1992), which was a continuation of 07/103,594, filed Oct. 2, 1987, now abandoned.

FIELD OF THE INVENTION

The present invention relates to an apparatus for extruding plural-component synthetic fibers and multiple single component fibers of different components in a spin pack. More particularly, the present invention relates to an improved polymer melt/solution spinning apparatus permitting a wide variety of plural-component and mixed mono-component fiber configurations to be extruded at relatively low cost, with a high density of spinning orifices, and with a high degree of fiber uniformity.

BACKGROUND OF THE INVENTION

As used herein, the term "disposable" describes a plate of metal or other suitable material which can be manufactured new by etching or some other low cost method at a cost which is less than the cost per use of a permanent plate designed to perform the same function.

For certain applications it is desirable to utilize a melt or solution spinning system to extrude trifocal shaped bicomponent fibers wherein only the three tips of the fiber lobes are of a different polymer from the central core of the fiber. In U.S. Pat. No. 4,406,850, there is disclosed a spin pack which extrudes sheath-core bicomponent fibers. For purposes of general reference and an understanding of the state of the art, the disclosure in that patent is expressly incorporated herein, in its entirety, by this reference. If that pack is utilized with a trilobal type spinneret, trilobal fibers are provided with a coating of the sheath fiber entirely around each fiber periphery. This is not, however, the same as having the tips of the trifocal configuration made of sheath polymer. To achieve only tip coverage by sheath polymer, it is necessary to create four separate streams of polymer in laminar flow within the counterbore or inlet hole of each spinneret orifice, A three-legged slot at the downstream end of the orifice would then issue a fiber of the required configuration. One might consider using the same spin pack design and melt spinning method described in aforesaid U.S. Pat. No. 4,406,850, modified by incorporating three notches cut into the buttons surrounding each spinneret inlet hole and by deleting the spacer shim. These equally spaced notches would allow the sheath polymer to pass through the added notches so as to combine with the core polymer, resulting in the desired four streams of polymer in the spinneret inlet holes and producing the desired type of fiber. For two reasons, this method and the apparatus are not altogether satisfactory. For efficient production, it is desirable to have about eight or so spinning orifices in each square centimeter of spinneret face area, to thereby provide approximately four thousand holes in a rectangular melt spin pack of manageable size. Further, it is desirable to have the spinning orifices positioned in staggered rows for best fiber quenching. The spin pack illustrated in the aforesaid patent is not appropriate for either of these requirements. Specifically, since core inlet holes must be drilled through a rib of metal lying between sheath polymer slots, the rib of metal is limited as to how thin it might be. These ribs have been successfully put on eight millimeter centers; the inlet holes can be drilled on centers spaced by approximately 2.5 millimeters, permitting twenty square millimeters per orifice, or a maximum density of five orifices per square centimeter. Furthermore, the prior patented spin pack requires that the orifices be arranged in straight rows, not staggered, in order that the core polymer holes can be drilled through the straight metal ribs.

It is also desirable to extrude very fine fibers for some applications. Short irregular fine fibers can be made by "melt blowing", or by a centrifugal spinning technique (i.e., cotton-candy machine), or by spinning a blend of incompatible polymers and then separating the two polymers (or dissolving one of the components). All of these techniques produce fibers which are very irregular, vary in denier, and are not continuous for very long lengths. There are known techniques for extruding more uniform continuous fine fibers. For example, U.S. Pat. Nos. 4,445,833 (Moriki) and 4,381,274 (Kessler) are typical of fairly recently developed methods of making such fibers. Moriki employs a technique wherein a number of core polymer streams are injected into a matrix or sheath stream via small tubes, one tube for each core stream. Each of Moriki's spinneret orifices produce a fiber with seven "islands in s sea" of sheath polymer. Such a spinneret is suitable for extruding continuous filament yarn with one hundred twenty-six filaments of perhaps 0.3 denier per filament, if the sheath polymer were dissolved away, leaving a bundle of one hundred twenty-six fine core fibers. At 0.3 denier per fiber, the yarn denier would be 37.8, suitable for fine fiber apparel and garments. The Moriki technique is not suitable for extruding large numbers (e.g., 1,000 to 10,000) of multicomponent fibers from each spinneret as is necessary for economical production of staple fibers via melt spinning. Even larger number of fibers per spinneret (e.g., 10,000 to 100,000) are necessary for economical wet spinning of polymer solutions. By using tubes to feed each core stream, the number of tubes is limited by the smallest practical size of hypodermic tubing available thereby requiring considerable space. Additionally, if very fine tubes are employed, it would be expensive to assemble them into their retainer plate. In cleaning the spin pack parts (typically, every week), it would be hard to avoid damaging the tubes. Since the tubes have an inside diameter with a very high ratio of length to diameter (i.e., L/D), it would be hard to clean the inside of each tube. The tube design would certainly make the parts too expensive to be discarded and replaced instead of being cleaned. When clean and undamaged, however, the Moriki device should make very uniform high-quality fibers.

The Kessler apparatus, on the other hand, is more rugged. This apparatus employs machined inserts, permitting a number of polymer side streams to be placed about the periphery of a central stream. Also, by using short tubes (see FIG. 11 of the Kessler patent), some side streams can be injected into the center of the main stream, giving a result which would be similar to that obtained by Morild. Again, size limitations on the machined insert, and the smallest practical side tubes, make the Kessler apparatus suitable for spinning a limited number of composite filaments per spinneret. Proper cleaning and inspection of the side stream tubes requires removing them from their support plate, a very tedious process for a spinneret with one thousand or more inserts. The Kessler technique may, however, be quite suitable for making continuous filament yarn, as descsibed above for Moriki.

Another class of bicomponent or multicomponent fibers are being produced commercially wherein the different polymer streams are mixed with a static mixing device at some point in the polymer conveying process. Examples of such processes may be found in U.S. Pat. Nos. 4,307,054 (Chion) and 4,414,276 (Kiriyama), and in European Patent Application No. 0104081 (Kato). The Kato device forms a multicomponent stream, in the same manner as does Morild, using apparatus elements "W" shown in FIG. 5 of the Kato disclosure. Kato then passes this stream through a static mixing device, such as the mixer disclosed in U.S. Pat. No. 3,286,992. The static mixer divides and re-divides the multicomponent stream, forming a stream with hundreds, or thousands, of core strums within the matrix stream. If the matra is dissolved away in the resulting fiber, a bundle of extremely free fibers is produced. Kato also discloses (in FIG. 7 of the Kato disclosure) that a mixed stream of two polymers may be fed as core streams torn second element of the "W" type wherein a third polymer is introduced as a new matrix stream. It should be noted that the apparatus of the present invention, particularly the embodiment illustrated in FIGS. 31–33 of the accompanying drawings, could be used as a less costly and more practical way to construct elements "W" of the Kato assembly.

Kiriyama discloses a method for extruding a fiber assembly that is much simpler than the Kato method, but results in much inferior fibers. The similarity is that Kiriyama employs a static mixer to blend two or more polymers before spinning them into fibers. A wire screen or other bumpy surfaced element is used as the spinneret. The result is that the polymer streams oscillate just prior to solidification, and alternately bond and unbond to each other in a manner to give a bonded fiber structure of primarily fibrous character. Kiriyama does not claim to make very fine fibers; rather, the illustration of FIG. 21 of the Kiriyama patent shows a typical assembly having fibers with an average denier of 2.6, easily attainable by normal melt spinning. Further, since Kiriyama simply blends two streams with the static mixers, and does not initially form "islands in a sea" as does Karo, Kiriyama's fibers are more of a laminar type (see Kiriyama FIGS. 8, 9 and 19), rather than a sheathcore type; some fibers have only one polymer, and in most of them, each polymer layer extends to the periphery of the fiber. The Kiriyama method requires very slow spinning because the fibers must be solidified very close to the screen spinneret; otherwise, all of the streams will simply merge into one large stream. The productivity is quite good due to a high spinning orifice density, but the highest productivity described in the patent is 4.75 gm/min/sq-cm (example 2), and this is no more than is achieved in normal staple spinning of 2.6 denier fibers.

Chion utilizes a technique similar to that of Kato except that Chion employs many closely spaced static mixen, and only one stream of each of the two polymers is fed to the mixer inlets. The equipment is much more rugged and practical than the delicate tubes employed by Karo; however, the resulting fibers are similar to the Kiriyama fibers, laminar in construction rather than "islands in a sea", since Chion starts with two haft-moon shaped streams at the top of the mixers and simply divides and re-divides. If the mixed melt is then divided into one thousand or more spinning orifices, one obtains bilaminer and multilaminar fibers with a few monocomponent fibers, but also no sheath-core fibers.

In addition to high productivity (i.e., grams of polymer per minute per square centimeter of spinneret surface area) and fiber uniformity (i.e., denier and shape), there are other important features that must be considered in devising practical spinning methods. One such consideration is cost, including both the initial purchase price of the spin pack and the maintenance cost thereafter. In the art described above, all of the polymer distribution plates are relatively expensive, thick metal plates which must be accurately drilled, reamed or otherwise machined at considerable expense. Moreover, with use, polymer material tends to solidify and collect in the distribution flow passages which must be periodically cleaned, and then inspected in order to ensure that the cleaning process has effectively removed all of the collected material. The small size of the flow passages renders the inspection process tedious and time-consuming and, therefore, imparts a considerable cost to the overall cleaning/inspection process. The high initial cost of the distribution plates precludes discarding or disposing of the plates as an alternative to cleaning.

In U.S. Pat. No. 3,787,162 (Cheetham) there is disclosed a spin pack for producing a sheath/core conjugate fiber. That spin pack utilizes a relatively thin (i.e., 0.020 inch) stainless steel orifice plate in which a plurality of orifices are cut. The cutting operation is relatively expensive, thereby rendering the orifice plate too expensive to be disposable instead of being periodically cleaned. As noted above, the periodic cleaning and the required post-cleaning inspection are of themselves quite expensive. Further, the density of orifices permitted by the cutting procedure is severely limited. Specifically, the orifice density that can be obtained in the Cheetham orifice plate is no greater than that obtained in the machined distribution plate disclosed in U.S. Pat. No. 4,052,146 (Sternberg) in which the orifice density is 2.93 orifices per square centimeter. Although not disclosed in the Cheerham patent, it is conceivable that one of ordinary skill in the art, armed with hindsight derived from the disclosure of the invention set forth below, might consider the possibility of etching, rather than cutting, the distribution orifices in the orifice plate. To do so, however, would not solve the problem. Cheetham discloses apertures having length L of 0.020 inch (i.e., the plate thickness) and diameters D of 0.009 inch, resulting in a ratio of L/D of 2.22. For ratios of LFD in excess of 1.50, it is necessary to drill or ream the holes, even if they are initially etched, in order to assure uniform diameters. The drilling/reaming procedure adds a significant cost to the plate fabrication process and, thereby, precludes discarding as an alternative to periodic cleaning of the plate.

It is also desirable that spin packs be useful for both melt spinning and solution spinning. Melt spinning is only available for polymers having melting point temperature less than its decomposition point temperature. Such polymers can be melted and extruded to fiber form without decomposing. Examples of such polymers are nylon, polypropylene, etc. Other polymers, such as acrylics, however, cannot be melted without blackening and decomposing. The polymer, in such cases, can be dissolved in a suitable solvent (i.e., acetate in acetone) of typically -twenty per cent polymer and eighty percent solvent. In a wet solution spinning process the solution is pumped, at room temperature, through the spinneret which is submerged in a bath of liquid (e.g., water) in which the solvent is soluble so that the solvent can be removed. It is also possible to dry spin the fibers into hot air, rather than a liquid bath, to evaporate the solvent and form a skin that coagulates, Molten polymers normally have viscosities in the range of 500–10,000 poise. The polymer solutions, on the other hand, have much lower viscosities, normally on the order of 100–500 poise. The lower viscosity of the solution requires a lower pressure drop across the spinneret assembly, thereby permitting relatively thin distribution plates and smaller assemblies when spinning plural component fibers. Generally, in known methods, the relatively high orifice packing density (i.e., orifices per square centimeter of spinneret surface) used for low viscosity solution spinning cannot generally be used for the high viscosity melt spinning. As indicated above, it is desirable to have a high orifice density, whether the spin pack is used for solution spinning or melt spinning.

In initially directing the polymer components of different types to appropriate distribution flow paths formed in the distributor plates, it is important that the pressure of the polymer be the same throughout each plane extending transversely of the flow direction. The reason for this is that significant transverse pressure differences prevent the different spun fibers from being mutually uniform. In order to compensate for transverse pressure irregularities that might occur as the polymer is spread over a large area from a relatively small polymer component inlet, typically required are long distribution apertures in which a high pressure drop is produced to minimize the effect of any lack of pressure uniformity created upstream by the spreading of the polymer flow. The long holes must be drilled, reamed, broached, etc., very accurately in a distributor plate that is relatively thick in order to provide the necessary length of distribution apertures. The thick plate and the accurate machining are both expensive and preclude any realistic possibility of rendering the plates disposable as an option to periodic cleaning. It is desirable, therefore, to provide a distribution plate which is sufficiently inexpensive as to be disposable, with accurate flow distribution paths defined therein, and which functions in conjunction with primary polymer feed slots that minimize pressure variations transversely of the flow direction and upstream of the distribution plate.

In the following description, the terms "etching or etched" are used to indicate the preferred method and distribution plate of the present invention. The use of these terms is for simplicity in describing the invention and is not intended to limit the scope of the invention. While etching is a preferred method, it is contemplated that other methods of forming the complex distribution patterns of the present invention may be used. For example, one such method useful for solution spinning packs is injection molding of polymeric materials. In some cases, punched metal plates could be used.

SUMMARY OF THE INVENTION

It is an object of the present invention to provide an improved melt/solution polymer spinning method and apparatus for extruding plural-component fibers wherein the density of spinneret orifices can be maximized.

It is another object of the present invention to provide an improved method and apparatus for melt/solution spinning polymer fibers using a disposable polymer distribution plate.

A further object of the present invention is to provide an improved melt/solution spinning method and apparatus for extruding plural-multicomponent fibers, each made up of multiple loosely bonded sub-fibers that can be separated to provide multiple low denier uniform micro-fibers from each extruded multi-component fiber.

It is still a further object of the present invention to provide an improved melt/solution polymer spinning apparatus for extruding a mixture of mono-component fibers consisting of different polymers.

Yet another object of the present invention is to provide a spin pack with a distribution plate that is sufficiently inexpensive to be disposable, that has distribution flow paths defined therein at maximally high density, and that functions in conjunction with primary polymer feed slots that minimize pressure variations transversely of flow at locations upstream of the distribution plate.

Yet another object of the present invention is to provide a spin pack with a distribution plate that is sufficiently inexpensive to be disposable, that has distribution flow paths defined therein which have dimensions sufficiently small to allow complex routing of individual polymer streams to any desired location within an array of spinning capillary inlet holes.

In accordance with one aspect of the present invention, a fiber extrusion spin pack assembly for forming synthetic fibers includes supply means for delivering plural mutually separated flowable polymer components under pressure; primary distribution means for delivering the mutually separated components to prescribed locations in the assembly;, a spinneret having an array of multiple spinneret orifices for issuing synthetic fibers from the spin pack assembly in a first direction, each spinneret orifice having an inlet hole at each upstream end; and at least a first disposable distributor plate positioned transversely to the first direction and between said primary distribution means and the spinneret, and having multiple distribution flow paths for conducting one or more of the mutually separated components from said primary distribution means to any or all of the inlet holes at the spinneret In another aspect of the present invention a fiber spin pack assembly includes a primary distribution means for supplying at least two polymer components; and at least one distribution plate in fluid communication with the primary distribution means. The distribution plate includes an upstream surface and a downstream surface; at least one etched first flow channel for distributing a first polymer component in one of the surfaces of the distribution plate, and at least one aperture extending through the at least one etched first flow channel for directing the first polymer component to an inlet hole of the spinneret plate; at least one etched second flow channel separate from the first flow channel for distributing a second polymer component in one of the surfaces of the distribution plate containing the at least one etched first flow channel and at least one aperture extending through the at least one etched second flow channel for directing the second polymer component to an inlet hole of the spinneret; and a spinneret plate parallel to and in fluid communication with the distribution plate and having a plurality of spinning orifices extending from the upper face of the spinneret plate to the lower face of the spinneret plate, each of the orifices-having an inlet hole on the upper face of the spinneret plate for receiving at least one of the polymer components.

In yet another aspect, the present invention provides a method of forming multiple synthetic fibers from plural respective different molten/solution polymer component. The method includes the steps of: (a) flowing the plural components, mutually separated, into a structure having plural parts; (b) in the structure, distributing each component to a respective array of inlet holes for multiple spinneret orifices in a spinneret plate such that each component flows into its own respective array of inlet holes without any other component to provide multiple mono-component fiber streams flowing through the spinneret orifices, the spinneret being one of the plural parts of the structure; wherein the fibers are issued in a first direction as streams from the structure by the spinneret orifices, Step (b) includes the substeps of (b.1) forming multiple distribution flow paths in at least one disposable distributor plate, having upstream and downstream surfaces; (b.2) disposing transversely to the first direction the at least one distributor plate to require the plural components to flow through the distribution flow paths; and (b.3) directing the mutually separated components through the distribution flow paths to the respective arrays of inlet holes.

The above and still further objects, features and advantages of the present invention will become apparent upon consideration of the following detailed description, especially when taken in conjunction with the accompanying drawings wherein like reference numerals in the various figures are utilized to designate like components.

BRIEF DESCRIPTION OF THE DRAWINGS

FIG. 4 is a view in section taken along lines 4—4 of

DETAILED DESCRIPTION OF THE PREFERRED EMBODIMENTS

Figure 1:
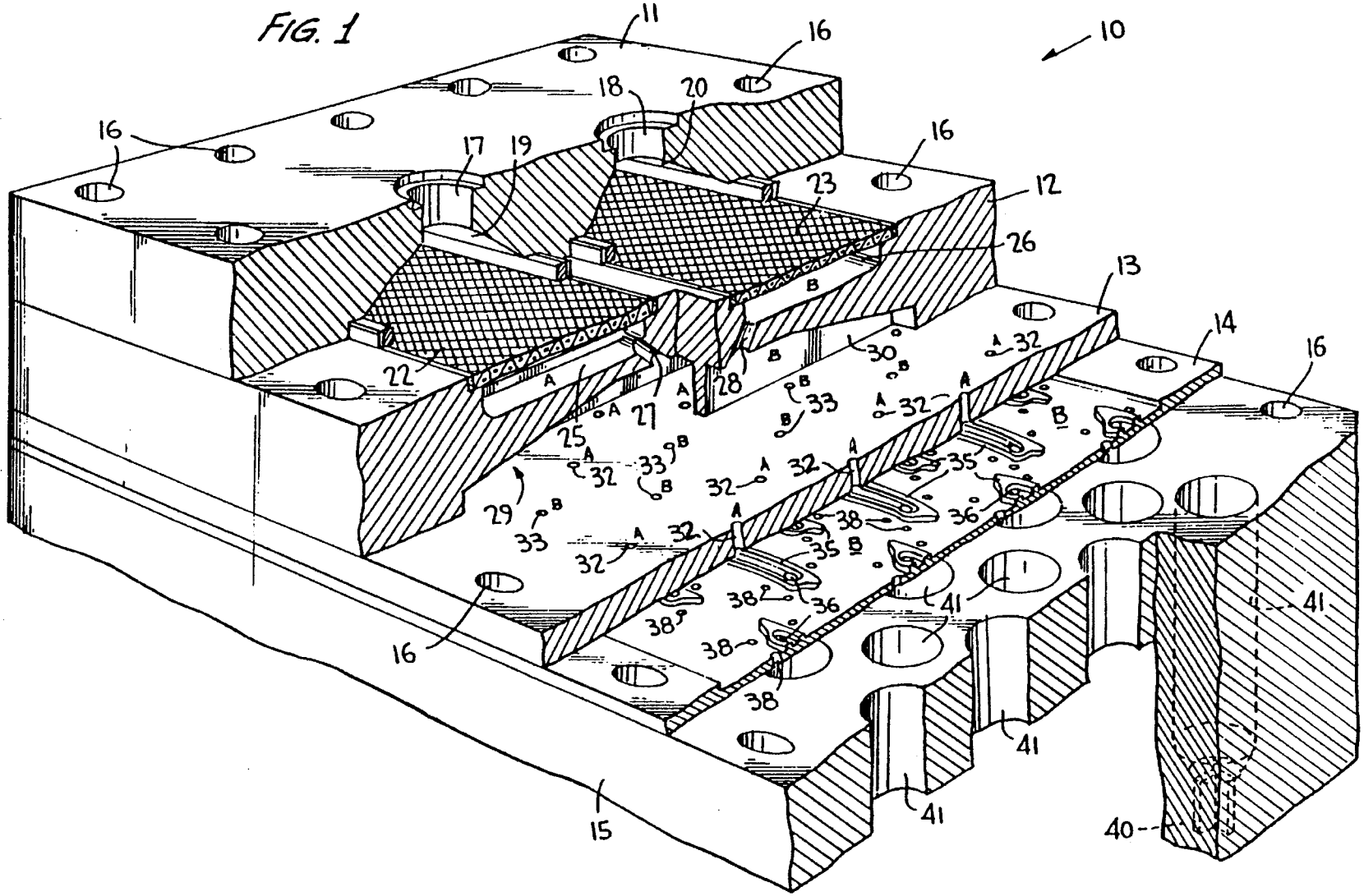
FIG. 1 is a view in perspective of a spin pack assembly constructed in accordance with the principles of the present invention.

The present invention concerns a disposable distributor plate (or a plurality of adjacently disposed distributor plates) in a spin pack in the form of a thin sheet in which distribution flow paths provide precisely formed and densely packed passage configurations. The distribution flow paths may be: etched shallow distribution channels arranged to conduct polymer flow along the distributor plate surface in a direction transverse to the net flow through the spin pack; and distribution apertures etched through the distributor plate. The etching process (which may be photo-chemical etching) is much less expensive than the drilling, milling, naming or other machining/cutting processes utilized to form distribution paths in the thick plates utilized in the prior art). Moreover, the thin distribution plates (e.g., with thicknesses less than 0.10 inch, and typically no thicker than 0.030 inch) are themselves much less expensive than the thicker distributor plates conventionally employed in the prior art.

Etching permits the distribution apertures to be precisely defined with very mall length (L) to diameter (D) ratios (1.5 or less, and more typically, 0.7 or less). By flowing the individual plural polymer components to the disposable distributor plates via respective groups of slots in a non-disposable primary plate, the transverse pressure variations upstream of the distributor plate are minimized so that the small I/D ratios are feasible. Transverse pressure variations may be further mitigated by interposing a permanent metering plate between the primary plate and the etched distribution plates. Each group of slots in the primary non-disposable plate carries a respective polymer component and includes at least three, and usually more, slots. The slots of each group are positionally alternated or interlaced with slots of the other groups so that no two adjacent slots carry the same polymer component.

The transverse distribution of polymer in the spin pack, as required for plural component fiber extrusion, is enhanced and simplified by the shallow channels made feasible by the etching process. Typically the depth of the channels is less than 0.016 inch and, in most cases, less than 0.010 inch. The polymer can thus be efficiently distributed, transversely of the net flow direction of the spin pack, without taking up considerable flow path length, thereby permitting the overall thickness (i.e., in the flow direction) of the spin pack to be kept small. Etching also permits the distribution flow channels and apertures to be tightly packed, resulting in a spin pack of high productivity (i.e., grams of polymer per square centimeter of spinneret face area). The etching process, in particular photo-chemical etching, is relatively inexpensive, as is the thin metal distributor plate itself. The resulting low cost etched plate can, therefore, be discarded and economically replaced at the times of periodic cleaning of the spin pack. The replacement distributor plate can be identical to the discarded plate, or it can have different distribution flow path configurations if different polymer fiber configurations are to be extruded. The precision afforded by etching assures that the resulting fibers are uniform in shape and denier Referring specifically to FIGS. 1–10 of the accompanying drawings, a spin pack assembly 10 is constructed in accordance with the principles of the present invention to produce bicomponent fibers having a trilobal cross-section in which only the lobe tips are of a different polymer component (B) than the component (A) comprising the remainder of the fiber. The assembly 10 includes the following plates, sandwiched together from top to bottom (i.e., upstream to downstream), in the following sequence: a top plate 11; a screen support plate 12; a metering plate 13; an etched distributor plate 14, and a spinneret plate 15. The spin pack assembly 10 may be bolted into additional equipment (not shown) and is held in place, with the plates secured tightly together, by means of bolts 24 extending through appropriately aligned bolt holes 16. The aforesaid additional equipment typically includes tapped bolt holes for engaging the threaded ends of the bolts 24. The particular spin pack assembly 10 is configured to distribute and extrude two different types of polymer components A and B, although it will be appreciated that the principles described below permit three or more different polymer types to be similarly distributed and extruded. Generally cylindrical (or other shape, if desired) inlet ports 17 and 18, defined in top plate 11, receive the mutually separated polymer components A and B, respectively, from respective metering pumps (not shown). The upstream or inlet ends of pore 17, 18 are counterbored to receive respective annular seals 21 which prevent polymer leakage at pressures up to at least 5,000 pounds per square inch. These inlet ports 17, 18 are drilled or otherwise formed part-way through the top plate 11, from the upstream end of that plate, and terminate in respective side-by-side tent-shaped cavities 19, 20 formed in the downstream side of plate 11. Cavities 19, 20 widen in a downstream direction, terminating at the downstream side of plate 11 in a generally rectangular configuration, the long dimension of which is substantially co-extensive with the length dimension of the rectangular array of spinneret orifices described below. The combined transverse widths of the side-by-side cavities 19, 20 are substantially co-extensive with the width dimension of the spinneret orifice array.

The screen support plate 12, disposed immediately downstream of plate 11, is provided with filters 22, 23 at its upstream side for filtering the respective polymer components flowing out from cavities 19 and 20. Filters 22 and 23 may be made of sinterbonded screen or other suitable filter material. The filters are recessed in the upstream surface of plate 12 and are generally rectangular and generally co-extensive with the downstream openings in cavities 19 and 20. Below the recessed filter 22 there is a plurality of side-by-side slots 25 recessed in plate 12 for the A polymer component. Slots 25 may be generally rectangular tranzverso (i.e., transverse to the flow direction) cross-sectional configurations with the largest dimension extending transversely of the longest dimension of cavity 19. Slots 25 are disposed in side-by-side sequence along the length dimensions of filter 22 and cavity 19. Similar slots 26 are recessed in plate 12 below filter 23 for the B polymer component. From each A component slot 25, a drilled hole 27 extends generally downward and toward the longitudinal centerline of plate 12, terminating in a deep tapered slot 29 cut into the downstream side of plate 12. Similar drilled holes 28 extend generally downward and toward the longitudinal centerline from respective B component slots 26, each hole 28 terminating at respective deep tapered slots 30. Slots 29 and 30 have generally rectangular transverse cross-sections and diverge in a downstream direction in planes which include their longest cross-sectional dimension. That longest dimension is slightly greater than the combined lengths of each co-planar pair of slots 19 and 20. Importantly, the group of slots 29 is interlaced or positionally alternated along the length dimension of plate 12 with the group of slots 30 so that the A component slots 29 are spaced from one another by B component slots 30, and, of course, vice versa. Slots 29 and 30 terminate at the downstream side of plate 12.

The downstream side of screen support plate 12 abuts the upstream side of plate 13 in which an array of flow distribution apertures 32 (for component A) and 33 (for component B) are defined through the plate thickness. Apertures 32 for the A polymer component are aligned with the A component slots 29 in plate 12; particularly, apertures 32 are arranged in rows, each row positioned in downstream alignment with a respective slot 29 to distribute the branch of the component A flow received from that slot. The rows of A component apertures 32 are interlaced (i.e., positionally alternated) with rows of B component apertures 33 that are positioned to receive the B polymer component from respective B component slots 30.

Distributor plate 14 is a thin plate disposed immediately downstream of and adjacent metering plate 13. Distributor plate 14 may be etched (e.g., by photochemical etching) in a suitable pattern to permit the received mutually separated polymer components A and B to be combined in the desired manner at the inlet holes of the spinneret orifices. Alternatively, distributor plate 14 may be formed using any low cost method suitable for the accuracy needed. In the exemplary embodiment of FIGS. 1 through 10, the upstream side of distribution plate 14 is etched to provide a regular pattern of unetched individual dams 35, each dam being positioned to receive a respective branch of the flowing polymer component A through a respective metering aperture 32. In the illustrated embodiment, these dams 35 are elongated parallel to the length dimension of cavity 19 and transversely of the length dimension of slots 25 and 29. Each dam 35 is positioned to receive its inflow (i.e., from its corresponding metering aperture 32) substantially at its longitudinal center whereby the received component A then flows lengthwise therethrough toward opposite ends of the dam. At both ends of each dam 35 there is provided a distribution aperture 36 etched into plate 14 from its downstream side.

The remainder of the upstream side of distributor plate 14 (i.e., the part of the plate other than the dams 35) is etched to a preserved depth and serves as a large reservoir/channel for the B polymer component received from the multiple B component metering apertures 33. An array of distribution apertures 38 for the B component is etched into plate 14 from its downstream side at locations outside of the dams and mis-aligned with the B component metering apertures 33. The particular locations of the distribution apertures 36, 38 are selected in accordance with the locations of the spinneret orifice holes as described below.

The spinneret plate 15 is provided with an array of spinneret orifices 40 extending entirely through its thickness, each orifice having a counterbore or inlet hole 41. Each A component distribution aperture 36 is directly aligned with a respective inlet hole 41 so that the A component polymer is issued as a stream in an axial direction directly into the inlet hole, at or near the center of the hole. The distribution apertures 36 may be coaxial with their respective inlet hole 41, depending upon the desired configuration of the components in the extruded fiber or filament. For present purposes, concentricity is assumed. The B component distribution apertures 38 are arranged in sets of three, each set positioned to issue B component polymer in an axial direction into a corresponding spinneret orifice inlet hole 41 at three respective angularly spaced locations adjacent the periphery of the inlet hole. Typically, the B component distribution apertures 38 are equi-angularly spaced about the inlet hole periphery; however, the spacing depends on the final orifice configuration and the desired polymer component distribution in the final extruded fiber. The downstream end of each spinneret orifice 40 has a transverse cross-section configured as three capillary legs 42, 43 and 44 extending equi-angularly and radially outward from the orifice center. The B component distribution apertures 38 are axially aligned with the tips or radial extremities of the legs 42, 43 and 44; the A component apertures 36 are each aligned with the radial center of a respective three-legged orifice 40.

Figure 2:
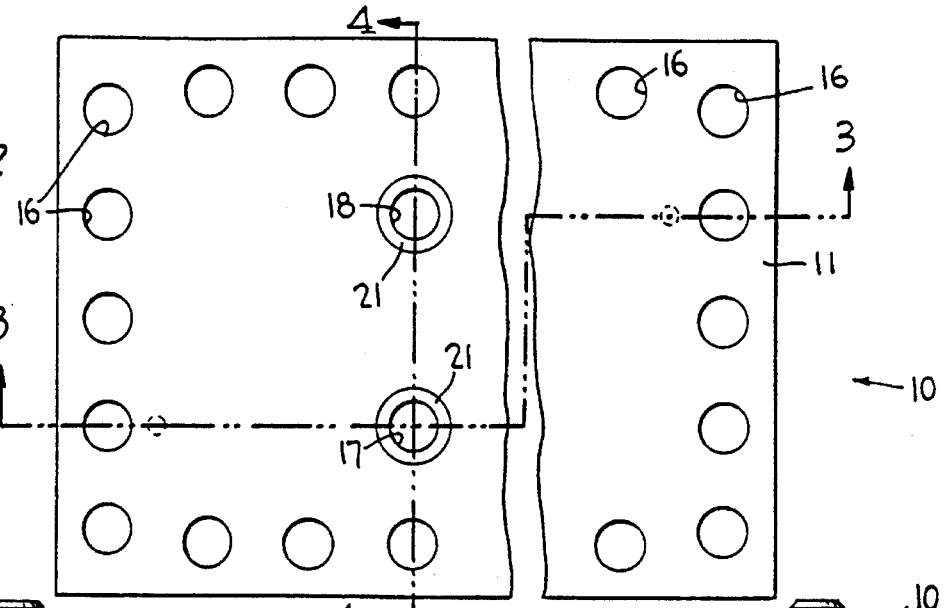
FIG. 2 is a top view in plane of the spin pack assembly of FIG. 1.
Figure 3:
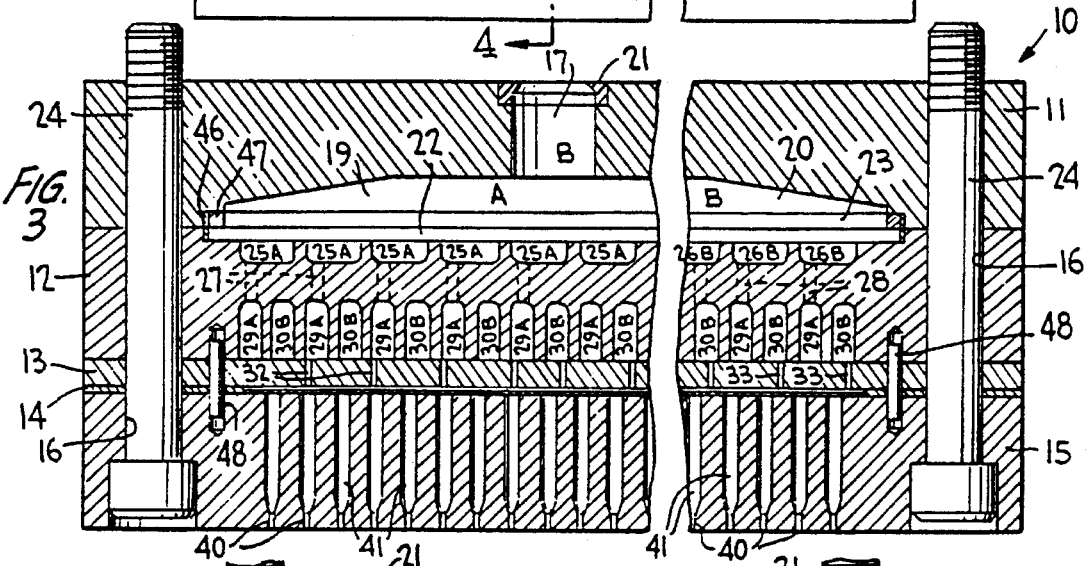
FIG. 3 is a view in section taken along lines 3—3 of FIG. 2.
Figure 4:
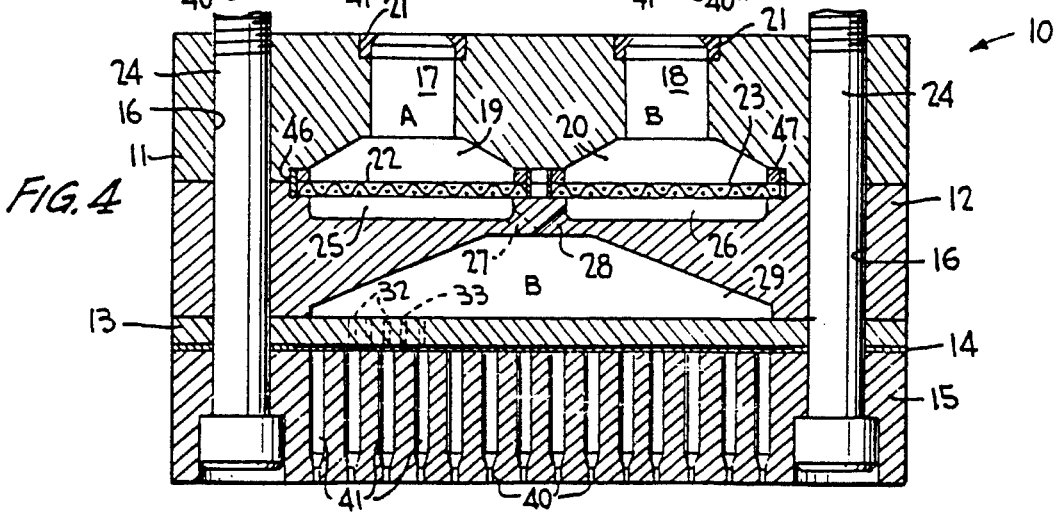
Figure 5:
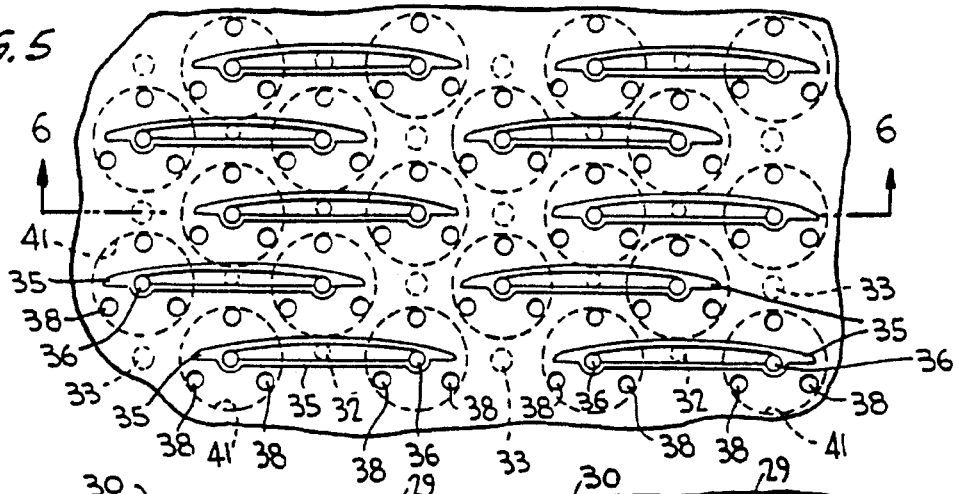
FIG. 5 is a top view in plane of a flow distributor plate employed in the spin pack assembly of FIG.
Figure 6:
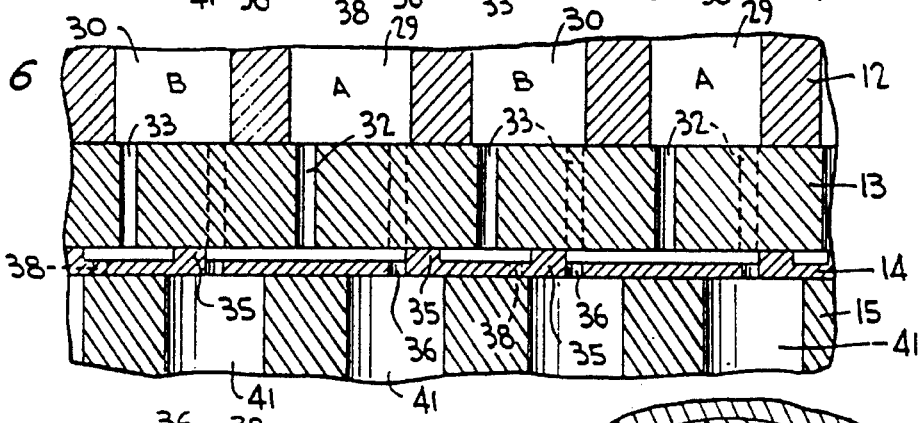
FIG. 6 is a view in section taken along lines 6—6 of FIG. 5
Figure 7:
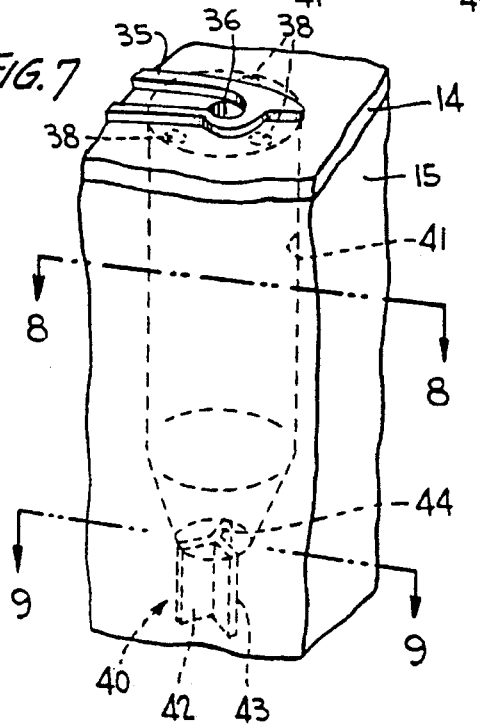
FIG. 7 is a view in perspective of a portion of the flow distribution plate and a spinning orifice employed in the spin pack assembly of FIG. 1.
Figure 8:
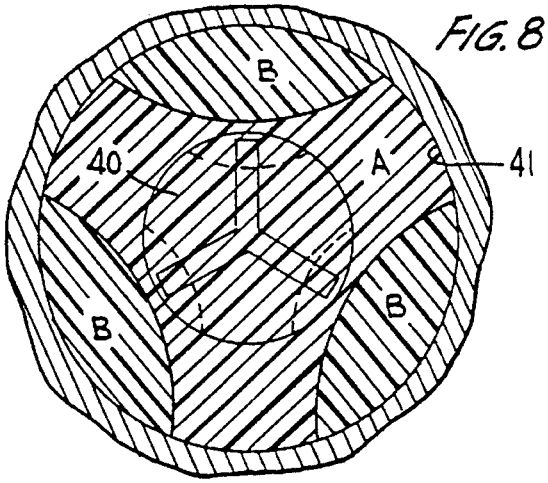
FIG. 8 is a view in section taken along lines 8—8 of FIG. 7.
Figure 9:
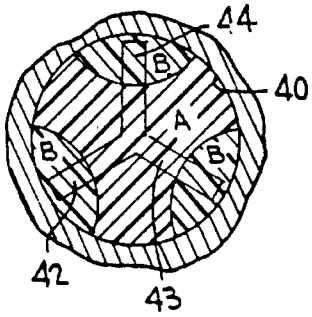
FIG. 9 is a view in section taken along lines 9—9 of FIG. 7.
Figure 10:
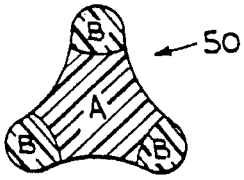
FIG. 10 is a transverse sectional view of a typical fiber formed by the spinning orifice illustrated in FIG. 7.

Spin pack assembly 10 is illustrated in FIGS. 1, 2 and 3 with its longitudinal dimension broken; the assembly may be several feet long. For example, a pack with an overall length (i.e., along the longitudinal dimension of filters 22, 23 or horizontally in FIGS. 2 and 3) of twenty-four inches can accommodate four thousand spinning orifices in spinneret 15, each polymer component (A, B) being fed to its respective cavity 19, 20, through four respective inlet ports 17, 18 distributed lengthwise of the respective cavity. The multiple inlet ports for each polymer component assure even polymer distribution to all pans of the filter screens 22, 23. Upright aluminum band-type seals 46 prevent leakage of the high pressure polymer from cavities 19 and 20. After the polymer passes through the filters 22, 2.3, the pressure is much lower and sealing is less of a problem. Optional aluminum seals 47 prevent polymer from passing around the ends of the filters without getting properly filtered. In such an embodiment the slots 29, 30 may be approximately 0.180 inch wide on 0.250 inch centers, with 0.070 inch of metal between the slots. Slots of this size are not expensive to fabricate but they may be much narrower and more closely spaced. For example, slots of 0.140 inch width, on 0.200 inch centers may be readily fabricated.

Figure 22:
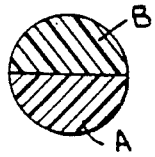
FIGS. 22, 23, 24, 25, 26, 27, 28 and 29 are views in transverse section of fibers that can be extruded by spin pack assemblies constructed in accordance with the present invention.
Figure 23:
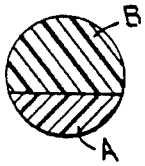
Figure 24:
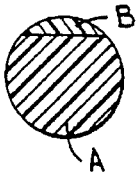

Only a single distributor plate 14 is illustrated in the spin pack assembly 10; it is to be understood, however, that the number and types of distribution plates is determined by the complexity of the polymer component distribution desired for each fiber. For example, spin pack assembly 10 is specifically configured to produce a fiber 50 having a trilobal transverse cross-section in which the tips of the lobes contain polymer component B while the remainder of the fiber contains polymer component A. Side-by-side bi-component fibers of the type illustrated in FIGS. 22–24, for example, may be fabricated with no distribution plates if the spinneret counterbores or inlet holes 41 are in straight rows directly under the rib partitions between slots 29, 30, and if the inlet hole entrances are larger in diameter than the rib thickness. The bottom of the screen support plate 12, in any event, should be lapped perfectly flat to avoid polymer leaks without the use of gaskets. Similarly, all distribution plates 13, 14 should be perfectly flat and free of scratches. In order to achieve spinning orifices in staggered rows and/or to fabricate a more complex arrangement of polymer types than the simple two-way splits of the type illustrated in FIGS. 22–24, one or more distribution plates is required.

The metering plate 13, in the particular embodiment illustrated for spin pack assembly 10, would typically have a thickness of about 0.180 inch, and the metering apertures 32, 33 are drilled entirely through that plate, typically with about 0.030 inch diameters. The length L and diameter D are such that the ratio L/D is at a relatively high value of six. Such relatively long holes must be drilled, not etched, making the metering plate a relatively expensive permanent part of the assembly which must be cleaned and reused each time the spin pack is removed for screen replacement (about once per week in a typical installation), Drilled and reamed relatively long holes of this type provide a very accurately distributed flow from slots 29, 30 to the final distribution plate 14, and result in minimal variation in the denier of the fibers being produced. Alternatively, a disposable distribution plate according to the present invention can be used in place of the metering plate 13 whereby the metering apertures would be formed (e.g., by etching) to have a L/D ratio of 1.5, or less and, in some cases, less than 0.7. Greater hole diameter variation is permissible with the etched plate and would result in greater denier variability. This greater variability is still acceptable for many textile applications, and the etched plate is so inexpensive as to be a disposable item, saving the cost of cleaning and hole inspection. The final spinning orifice inlet opening 41 is not too large and is provided with a relatively high L/D ratio, it will be the main pressure drop after the filters, assuring good denier uniformity with less accuracy required in the distribution plate passages. Conversely, a large or short spinning orifice is best used with a distribution plate 13 having long holes with accurately formed diameters.

The final distribution plate 14 has the distribution flow passages formed therein by, for example, etching, preferably photo-chemical etching. The use of etching permits very complicated arrangements of slots and holes in a relatively thin sheet of stainless steel (or some other appropriate metal). The cost of the parts is quite low and is unrelated to whether the sheet has a few holes and slots or a great many holes and slots. Quite accurate tolerances can be maintained for the locations of holes and slots relative to the two dowel pin holes 48 provided to accurately register plates 12, 13, 14 and 1S with one another. By way of example, distribution plate 14 has a thickness of 0.020 inches and is etched at its upstream or top surface to a depth of 0.010 inch to form the polymer dams 35 in the appropriate distribution pattern. The dams 35 are masked and not etched, as are the peripheral edges of plate 14, particularly in the region of bolts 24. The etching produces the large B component polymer reservoir as well as the individual A component slots disposed interiorly of dams 35.

In operation, the core polymer component A from alternate slots 29 flows through holes 32 in metering plate 13 into the slots defined by dams 35. The A component is received generally at the longitudinal center of those slots and flow from there in opposite longitudinal directions to pass through holes 36 centered over respective spinneret orifice inlet holes 41. The sheath polymer component B flows from slots 30 through metering apertures 33 into the reservoir or channel surrounding the dams 35 at the upstream surface of distribution plate 14. The B component flows radially outward from holes 33 to distribution apertures 38 through which the B component flows down to the inlet holes 41 of the spinning orifices. Each inlet hole 41 is fed by B component polymer, flowing in an axial direction, from the three respective distribution apertures 38. In particular, distribution apertures 38 are aligned directly over the extremities of the capillary legs in the three-legged outlet opening at the bottom of spinning orifice 40 The flow of a single interior stream of core polymer A and the three streams of sheath polymer B into each spinning orifice inlet hole 41 forms a composite polymer stream in the inlet hole 41 having a pattern illustrated in FIGS. 8 and 9. When this composite stream reaches the three-legged orifice 40, the result is a fiber of the type illustrated in cross-section in FIG. 10 wherein the sum of the three portions of the sheath or tip polymer B constitutes approximately the same area as the central or core polymer component A. This would be the case if the metering pumps supplying sheath and core polymer to assembly 10 are delivering an equal volume of each molten polymer component. The speed of the pumps is readily adjustable so that fibers can be made which vary considerably from this configuration. For example, fibers varying from ten percent core area to ninety percent core area are possible, the remainder being taken up by the sum of the three tip or lobe portions. Polymer dams 35 serve to keep the sheath and core polymer separated during flow of those polymers through the distribution plate 14.

Figure 19:
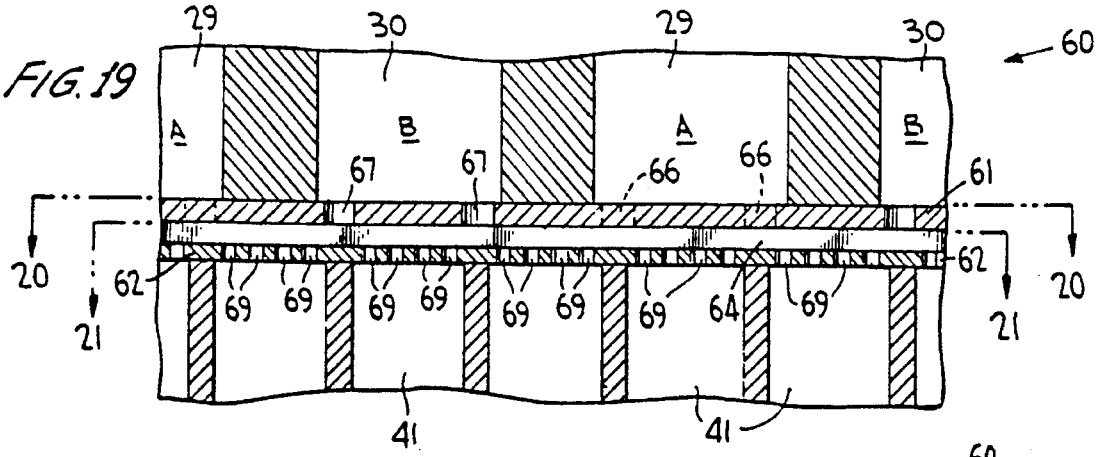
FIG. 19 is a side view in section of a portion of another embodiment of a spin pack assembly constructed in accordance with the principles of the present invention.
Figure 20:
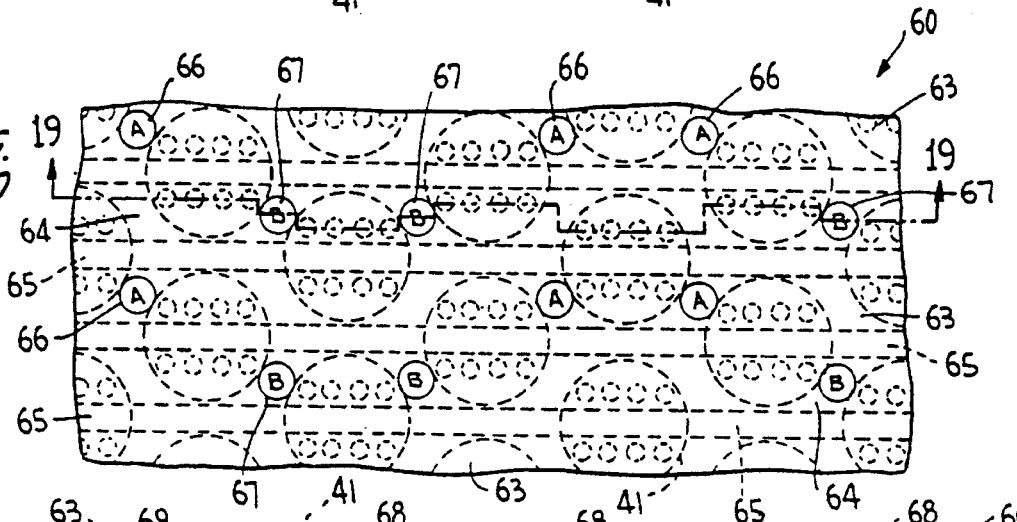
FIG. 20 is a view taken along items 20—20 of FIG. 19.
Figure 21:
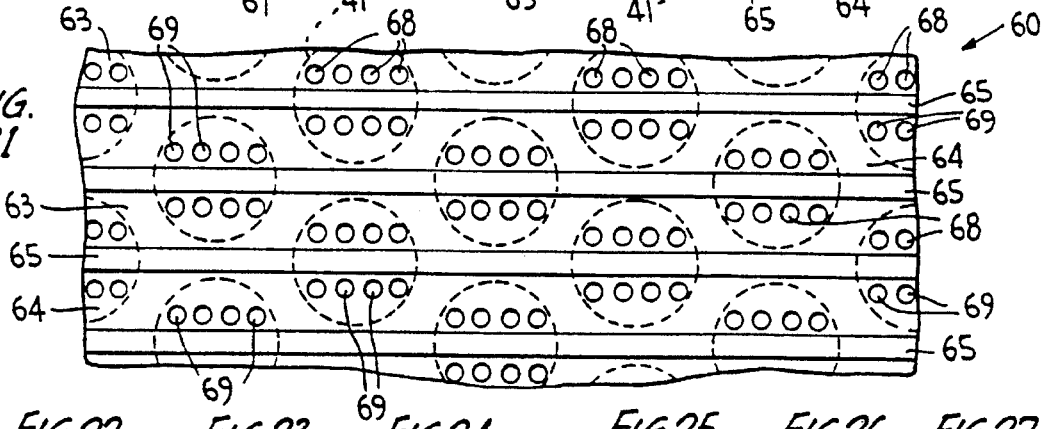
FIG. 21 is a view taken along lines 21—21 of FIG. 19.

Another spin pack assembly embodiment 60 of the present invention is illustrated in FIGS. 19, 20 and 21 of the accompanying drawings to which specific references is now made. Spin pack assembly 60 is configured to extrude profiled bicomponent fibers, having side-by-side components, of the type illustrated in transverse cross-section in FIGS. 22, 23 and 24. Screen support plate 12 has slots 29, 30 defined in its downstream side which abuts the upstream side or surface of a first etched distributor plate 61. The downstream side of distributor plate 61 is etched to form discrete channels 63 for the A component polymer and discrete channels 64 for the B component polymer. Channels 63 and 64 are separated by un-etched divider ribs 65 and are transversely alternated so that no two adjacent channels carry the same polymer component. Channels 63 and 64 extend across substantially the entire width of the spinneret orifice array and transversely of the length dimension of slots 29. In addition, each rib 65 overlies a respective row of spinneret orifice inlet holes 41 so as to diametrically bisect the holes in that row. The upstream side of distributor plate 61 is etched to provide an array of A component distribution apertures 66 and an array of B component distribution apertures 67. The A component distribution apertures are etched through the plate to communicate with A distribution channels 63 at the downstream side of the plate; the B component distribution apertures 67 are etched through to communicate with the B distribution channels 6,t. Distribution apertures 66 and 67 are oriented so as to be transversely mis-aligned from the inlet holes 41 of the spinneret orifices.

Figure 30:
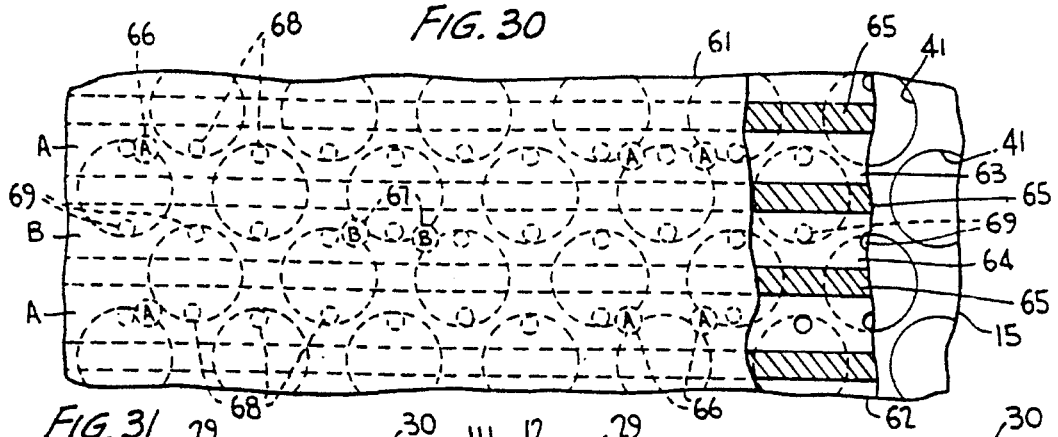
FIG. 30 is a view similar to FIG. 21 but showing a modified flow distributor plate that may be employed with the embodiment illustrated in FIG. 19.

A final etched distributor plate 62 is disposed immediately downstream of etched distributor plate 61, and abuts both plates 61 and the upstream side of spinneret plate 15. An array of final distribution apertures 68 for component A is etched through plate 62 at locations aligned with the A component distribution channels 63. A further array of final distribution apertures 69 for component B is etched through plate 62 at locations aligned with the B component distribution channels 64. The final distribution apertures in each of these arrays are clustered in groups so that the apertures in each group overlie one transverse side of a respective inlet hole 41. In the particular assembly embodiment 60 illustrated in FIGS. 19–21, the groups include four apertures arranged in spaced alignment along the length of the channels 63, (54, each aperture in a group being positioned to issue its polymer in an axial direction directly into the corresponding spinneret inlet hole 41. Thus, on opposite sides of each dividing fib 65 there are four apertures 68 for component A and four apertures 69 for component B, thereby permitting eight discrete polymer streams to be issued into each inlet hole 41. The cluster arrangement of apertures 68 and 69 can be varied as required for particular fiber configurations. For example, as illustrated in FIG. 30, the final distributor plate 62 may be provided with final distribution apertures arranged such that only one stream of each component A and B is issued directly into each spinneret inlet hole 41. Thus, there is only one final distribution aperture 68 for component A associated with each inlet hole 41; likewise, only one final distribution aperture 69 for component B is associated with each inlet hole 41.

The spin pack assembly 60 of FIGS. 19–21, and the modified version thereof illustrated in FIG. 30, permit extrusion of side-by-side bicomponent fibers, and permit the spinning orifices to be in staggered rows with inlet hole spacings much closer than could be achieved without distribution plates. For example, in the embodiment illustrated in FIGS. 19–21, the spinning orifices may be on 0.200 inch longitudinal centers in staggered rows disposed 0.060 inch apart. The embodiment illustrated in FIG. 30 has twice the density, with a longitudinal spacing of 0.100 inch. In both cases, two distributor plates are employed, both being etched to provide for the lowest possible cost of such plates. Distributor plate 61, in the illustrated embodiment, may be 0.030 inch thick, and slots 63, 64 may be 0.015 inch deep, 0.040 inch wide, and positioned on 0.060 centers. Apertures 66, 67 are etched through the remaining thickness of the plate into the slots 63, 64, respectively, and, therefore, in assembly 60 have a length of 0.015 inch. The final distribution apertures 68, 69 etched in plate 62 extend entirely through the plate which may have a thickness of 0.010 inch.

In operation, polymer component B flows from alternate slots 30 through the etched apertures 67 into alternate channels 64 and then through final distribution apertures 69 into respective inlet holes 41. Polymer component A flows from alternate slots 29 through apertures 66 into channels 63 and then through final distribution apertures 68 into respective inlet holes 41. The resulting fiber has a cross-sectional component distribution of the type illustrated in any of FIGS. 22, 23 or 24, depending upon the rate of the two polymer component metering pumps.

Figure 25:
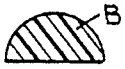
Figure 26:
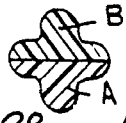
Figure 27:
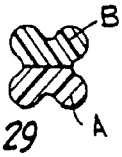
Figure 28:
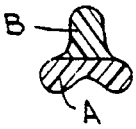
Figure 29:
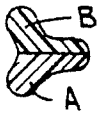

The apparatus of FIG. 60 may also produce fibers of the type illustrated in FIGS. 26 through 29, depending upon the shape of the final spinning orifice 40 and the orientation of the final distribution apertures 68, 69 relative to the spinning orifices 40. The embodiment illustrated in FIG. 25 may be produced if the two components A and B are polymer types that bond weakly to one another so that the two components, in the final extruded fiber, may be separated from the bicomponent fiber configuration illustrated in FIG. 22, for example.

Figure 11:
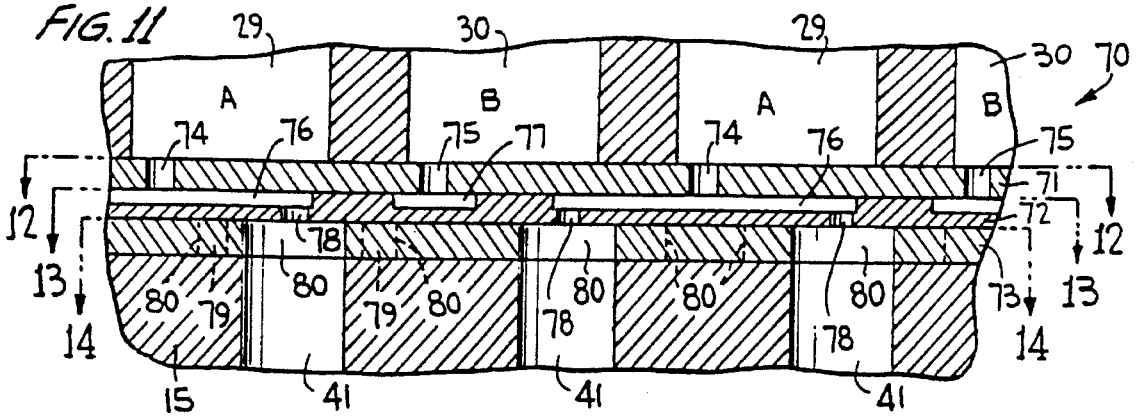
FIG. 11 is a side view in section of a portion of a spin pack assembly comprising a second embodiment of the present invention.
Figure 12:
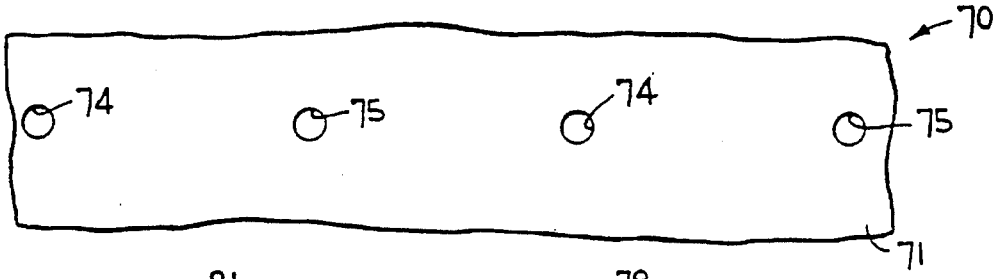
FIG. 12 is a top view in plane, taken along lines 12—12 of FIG. 11, of a metering plate employed in the spin pack assembly embodiment of FIG. 11.
Figure 13:
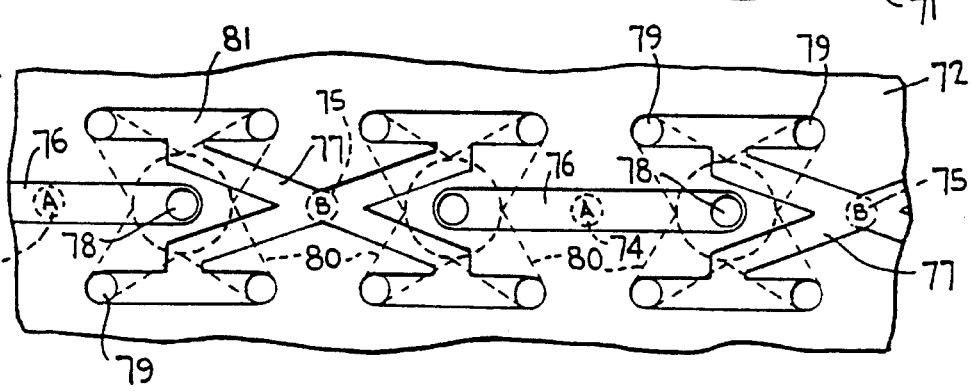
FIG. 13 is a top view in plane, taken along lines 13—13 of FIG. 11, of a distributor plate employed in the embodiment of FIG. 11.
Figure 14:
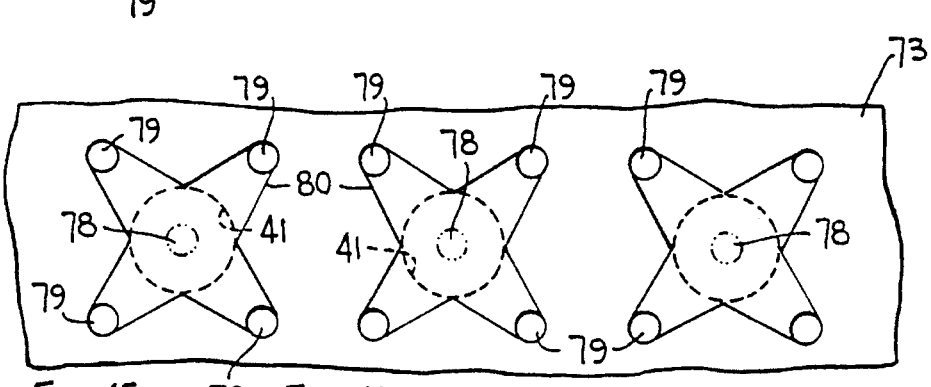
FIG. 14 is a top view in plane, taken along lines 14—14 of FIG. 11, of a second distributor plate employed in the spin pack assembly embodiment of FIG. 11.
Figure 15:
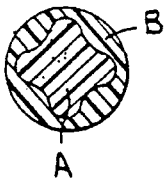
FIGS. 15, 16, 17 and 18 are views in transverse cross-section of respective fibers that may be extruded in accordance with the principles of the present invention.
Figure 16:
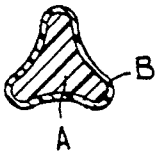
Figure 17:
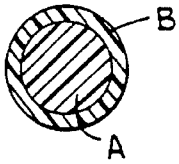

The versatility of the present invention may be demonstrated by the spin pack assembly embodiment 70 illustrated in FIG. 11 in which ordinary sheath-core fibers of the type illustrated in FIGS. 15–18 may be produced. The sheath-core fiber is the primary fiber configuration extruded by the spin pack assembly illustrated and described in aforementioned U.S. Pat. No. 4,406,805. Referring specifically to FIGS. 11–14 of the accompanying drawings, spin pack assembly 70 includes an etched metering plate 71 disposed immediately downstream of screen support plate 12 in abutting relationship therewith. A first plurality of metering apertures 74 for component A is etched through plate 71, each apertures 74 being positioned to receive and conduct A component polymer from a respective slot 29 in plate 12. A second plurality of metering apertures 75 is also etched through plate 71, each aperture 75 being positioned to receive and conduct B component polymer from a respective slot 30 in plate 12. An intermediate plate 72 has a first array of channels 76 etched in its upstream side, each channel 76 being positioned to receive A component polymer from a respective metering aperture 74. Channels 76 are generally rectangular and have their longest dimension oriented transversely of the slot 29. Each channel 76 is approximately centered, longitudinally, with respect to its corresponding metering aperture 74 so that received component A polymer flows longitudinally in opposite directions toward the ends of the channel. Distribution apertures 78 are etched through the downstream side of the plate 72 at each end of each channel 76 to conduct the component A through plate 72. Each distribution aperture 78 is positioned over a respective spinneret inlet hole 41 and, in the particular embodiment illustrated in FIGS. 11–14, is co-axially centered with respect to its associated inlet hole 41. Whether co-axially centered or not, each distribution aperture 78 is positioned to conduct the A component polymer in an axial direction into an inlet hole 41.

A second array of distribution channels 77 is also etched in the upstream side of distributor plate 72 and serves to conduct the B component polymer, isolated from the A component polymer. Each distribution channel 77 is generally X-shaped and has an expanded section 81 at each of its four extremities. The expanded portions 81 are generally rectangular with their longest dimension extending generally parallel to the channels 76. The center of each channel 77, at the cross-over of the X-shape, is positioned directly below a respective B component metering aperture 75 so that the received B component flows outwardly in channel 77 along the legs of the X-shape and into each expanded section 81. At both ends of each expanded section 8 1 there is a distribution aperture 79 etched through to that expanded section from the downstream side of plate 72. The B component polymer thus flows through the plate via eight distribution apertures for each distribution channel 77 and for each metering aperture 75.

A final etched distributor plate 73 has multiple generally star-shaped (i.e., fourpointed stars) final distribution apertures 80 etched therethrough, each aperture 80 being centered over a respective spinneret inlet hole 41 and under a respective A component distribution aperture 78 in plate 72. The four legs of the star-shaped aperture extend radially outward to register with respective B component distribution apertures 79 in plate 72. The extremity of each star leg is rounded to match the contour of its corresponding aligned aperture 79 at which point the periphery of aperture 80 is substantially tangent to the corresponding aperture 79. In this regard, it will be appreciated that the star shape is not crucial, and that the aperture 80 can be a rounded square or rectangle, a rounded triangle, a circle, or substantially any shape. In particular, the final distribution aperture 80 can be any configuration which permits the B component to be conducted radially inward toward that inlet hole for each of the plural (four, in this case) B component distribution apertures. It is very much desirable that the periphery of aperture 80, whatever the aperture configuration, be tangential to aperture 79 in order to effect smooth flow transition from an axial direction (in aperture 79) to a radial direction through aperture 80.

In a particular example, each of etched plates 71, 72 and 73 may be 0.025 inch thick, although plates of lesser thickness may be employed. The A component flows from alternate slots 29 through etched holes 74 in plate 71 into slots 76 etched in the top surface of plate 72. From slots 76 the A component polymer flows through distribution apertures 78 and then through the final distribution aperture 80 in an axial direction into a corresponding spinneret inlet hole 41. The sheath polymer component B flows through metering apertures 75 etched in plate 71 and then into distribution channels 77 etched in the top half of plate 72. From channels 77 the B component polymer flows through distribution apertures 79 to the radial extremities of final distribution apertures 80. The distribution aperture 80 directs the B component polymer radially inward toward the corresponding inlet hole 41 from four directions so as to provide a uniform layer of sheath polymer around the core polymer A issued axially into that inlet hole.

Figure 18:
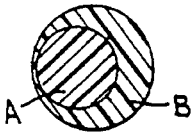

Metering plate 71 may be eliminated if plate 72 has its distribution channels etched on its downstream side; however, this would make the holes feeding channels 76 and 77 much shorter, increasing the variability of flow from hole to hole, thereby increasing the denier variability and the variation in the: sheath-to-core ratio from hole to hole. Conversely, metering plate 71 may be made thicker, with long accurate holes (drilled and reamed, or drilled and broached) for better uniformity. If it is desired to make a sheath-core fiber with an eccentric core, as illustrated in FIG. 18, it is only necessary to locate distribution apertures 78 eccentrically with respect to spinneret inlet holes 41. The fiber configuration illustrated in FIG. 15, wherein the core component A bulges radially outward into a lobed configuration within the circular sheath component B, may be achieved by positioning the B component distribution apertures 79 more radially inward so as to partially overlap the periphery of inlet hole 41. Whether metering plate 71 is a thin etched plate, or a thick drilled plate, the distribution plates 72 and 73 are thin etched plates that can be discarded because the plate itself, and the etching process, are relatively inexpensive as compared to the overall cost of the other items in the spin pack.

Figure 41:
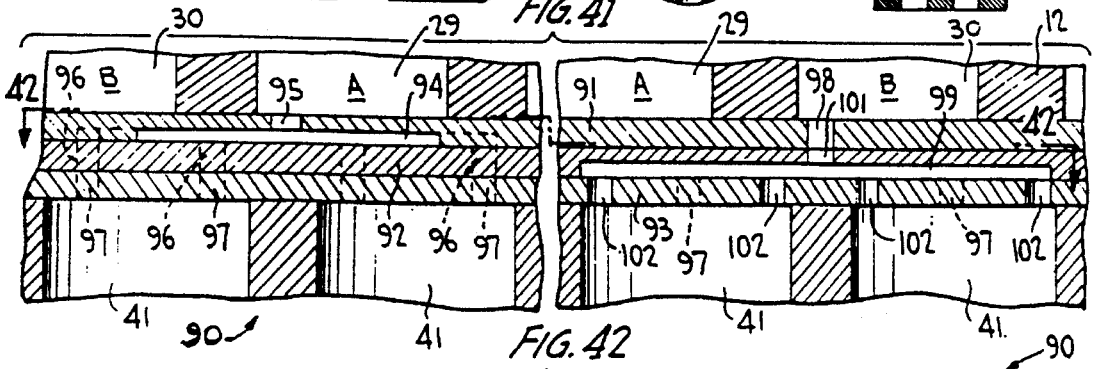
FIG. 41 is a side view in cross-section showing portions still another spin pack assembly constructed in accordance with the principles of the present invention.
Figure 42:
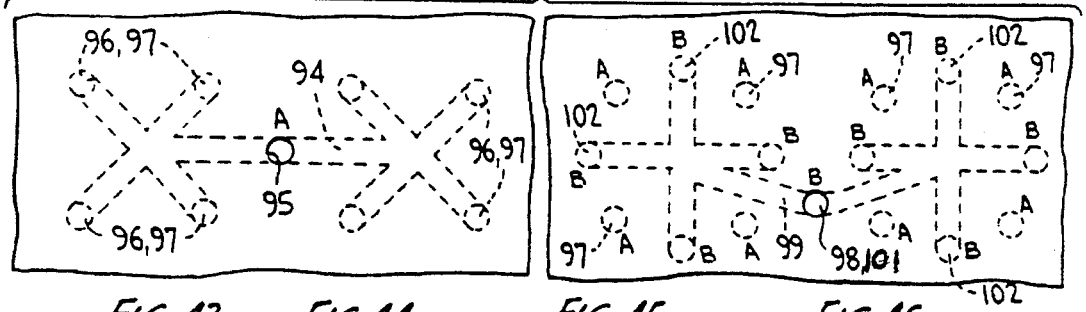
FIG. 42 is a plane view taken along lines 42—42 of FIG. 41.

Referring now to FIGS. 41 and 42, a spin pack assembly 90 of the present invention includes three etched distributor plates 91, 92, 93 and is capable of extruding multi-component fibers of the type illustrated in FIGS. 43, 44, 45 and 46. The upstream distributor plate 91 has an array of A component distribution channels 94 etched in its downstream side. Each distribution channel includes an elongated linear portion extending transversely of the lengths of slots 29. At its opposite ends each channel branches out radially in four equi-angularly spaced directions, thereby providing an appearance, in plan view, of two X-shaped portions connected at their centers by a linear portion. The upstream side of plate 91 is etched to provide multiple A component distribution apertures 95, each communicating with the center of the linear portion of a respective distribution channel 94 and with a respective A component slot 29 in plate 12. The intermediate distributor plate 92 is etched entirely through at locations aligned with the extremities of each X-shaped portion of the channels 94 to provide eight distribution apertures 96 for the A component for each channel 94. An array of final A component distribution apertures 97 are etched entirely through the final distribution plate 93, each aperture 97 being axially aligned with a respective aperture 96 in plate 92. Each individual X-shaped portion of the channels 94 is centered over a respective spinneret hole 41 such that its four distribution apertures 96 are positioned at 90°-spaced locations at the periphery of that inlet hole. The A component polymer is thus issued in an axial direction to each inlet hole 41 from four equi-angularly spaced locations.

Plate 91 is also provided with a plurality of initial distribution apertures 98 etched entirely through the plate, each aperture communicating with a respective B component slot 30 in plate 12. The downstream side of intermediate plate 92 has an array of channels 99 etched therein, each channel 99 having an elongated portion which branches out radially from its opposite ends in four equi-angularly spaced directions. The elongated portion of each channel 99 communicates at its center with apertures 98 in plate 91 via aligned apertures 101 etched through the upstream side of plate 92. The radially outward extensions at the ends of each channel 99 form X-shaped portions centered over respective spinneret inlet holes 41, there being one such portion for each inlet hole. The X-shaped portions of the B distribution channels 99 are angularly offset by 45° relative to the X-shaped portions of the A distribution channels 94. An array of final B component distribution apertures 102 is etched through final distributor plate 93 at the extremities of each X-shaped portion of channel 99. Apertures 102 are equi-angularly positioned at the periphery of each inlet hole 41, interspersed between A component apertures 97, to issue B component polymer from four locations into each inlet hole in an axial direction. In this manner, eight discrete streams of alternating polymer type are issued from eight equi-angularly spaced locations into each spinneret inlet hole.

In spin pack assembly 90, each B component aperture 98 supplies B type polymer for two inlet holes 41, and each A component aperture 95 supplies A type polymer for two inlet holes 41. Each inlet distribution aperture 95 for the A component is oriented directly between the two inlet holes, and feeds the A polymer along a linear (i.e., straight line) section of channel 94. Each initial distribution aperture 98 for the B component is oriented generally between the two inlet holes it serves but is offset from alignment with the inlet hole centers in order to permit the elongated portion of channel 99 to be curved or bent and thereby provide access to its center of its X-shaped extremities without interfering with one or another of the radial legs of the extremities.

As indicated above, spin pack assembly 90 illustrated in FIGS. 41 and 42 is capable of extruding multi-component fibers of the types illustrated in FIGS. 43, 44, 45, 46 and 47, depending upon the shape of the final spinneret orifice, the relative rates of flow of the polymer components A and B, etc. For the fibers illustrated in FIGS. 43, 4.4, 45 and 46, appropriate orifice configurations are shown directly above the fiber configurations produced thereby. The produced fibers may be durable fibers in which the two components A and B adhere well to one another. It may be desirable, however, to split the components apart so as to increase the effective fiber yield from any spinneret. It is well known that fibers finer than two denier are more difficult to extrude than are coarser fibers. If one were to extrude 0.5 denier fibers via conventional melt spinning technology, the spin pack productivity would be poor, and the spinning performance would be poor relative to coarser fibers. It has been suggested in the prior art to extrude fine fibers by spinning a bicomponent fiber, such as the fiber illustrated in FIG. 43, from poorly adhering polymers of a denier about two; and then subjecting the fiber to mechanical action (such as a carding operation) which causes each fiber to split apart into eight fibers of about 0.25 denier each. While such an approach is not new, the bicomponent spinning apparatus of the present invention renders it much less expensive to obtain the necessary equipment for providing this microfiber production. In essence, the present invention permits nearly any desired arrangement of polymers within a single extruded fiber by changing very inexpensive etched distributor plates in a general-purpose bicomponent spin pack assembly. The outer shape of the fiber, of course, is determined by the spinneret shape and cannot be changed without considerable expense.

Figures 43, 44, 45, 46, 47:
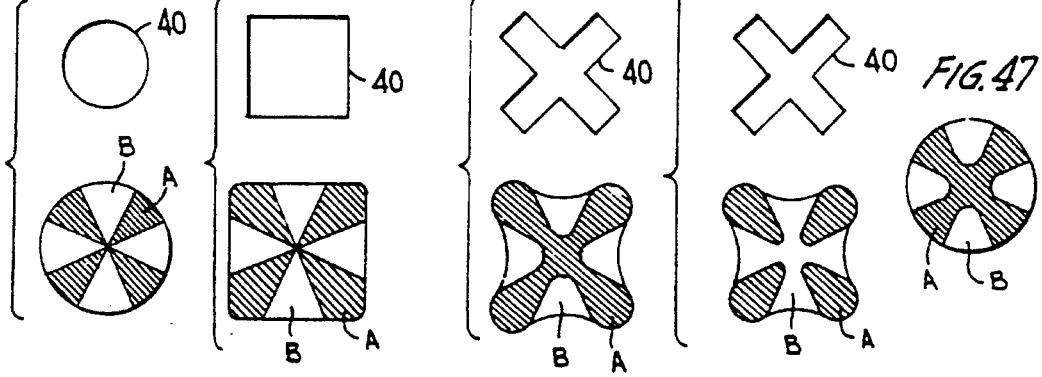
FIGS. 43, 44, 45 and 46 are views showing different spinneret orifice configurations that may be employed in conjunction with the spin pack assembly of FIG. 41, and corresponding transverse cross-sectional views of respective fibers that may be extruded by those orifices.
FIG. 47 is a view in transverse cross-section of another fiber configuration that may be extruded by the orifice of FIG. 43.

Referring again to FIGS. 41 and 42, polymer A passes from slots 29 through respective orifices 95 into distribution channels 94 in which the polymer flows transversely of the net flow direction. At the ends of each channel 94 the polymer is redirected in the axial flow direction through apertures 96, 97 and into the inlet hole 41 adjacent the peripheral wall of that hole. Polymer B flows from slots 30 through apertures 98, 101 into channel 99 in which the polymer flows transversely of the net axial flow direction. Upon reaching the extremities of channel 99 the B component polymer is redirected axially through apertures 102 and into inlet holes 41 at locations spaced 45° from the A component streams. If the two metering pumps for the polymer components A and B deliver equal volume of polymer, the polymer streams in the counterbore or inlet hole 41 takes the configuration illustrated in FIG. 43 wherein eight streams, having cross-sections corresponding to one-eighth sectors of a circle, flow side-by-side. If the round spinneret orifice is used the final fiber is that illustrated in FIG. 43. A square spinneret orifice provides the fiber illustrated in FIG. 44. Quadri-lobal orifices produce the fiber configurations illustrated in FIGS. 45 and 46. The fiber in FIG. 45 is formed if the A component is delivered at a greater flow rate than the B component. If the B component flow rate is greater than the A component flow rate, the fiber configuration illustrated in FIG. 46 obtains.

A possible modification of the spin pack assembly 90 would involve etching a circular recess in the downstream side of the final distributor plate 93 at a larger radius than, and circumferentially about, the inlet hole 41 of each (or some) spinneret orifice hole 41. This arrangement creates an annular cavity about the periphery of the inlet hole so that the A and B polymer components flow down over the edge of the inlet hole periphery rather than in an axial direction into the hole. Such an arrangement permits a smaller inlet hole diameter to be utilized, a feature which is not normally advantageous since smaller inlet holes or counterbores are more costly to drill. However, if it is desired to have a great many closely spaced spinning orifices, large counterbores or inlet holes which nearly touch each other greatly weaken the spinneret plate. This method, therefore, with a smaller counterbore or inlet hole does have certain advantages. The annular cavities thusly produced can be large enough to nearly touch each other since the final distributor plate 93 is not required to have any significant strength. The spinneret plate 15, however, must not be weak, in order to avoid bowing at its center under the effects of the pressurized polymer. This bowing causes the various plates to separate and permits the two polymer components to mix at undesired locations.

Figure 31:
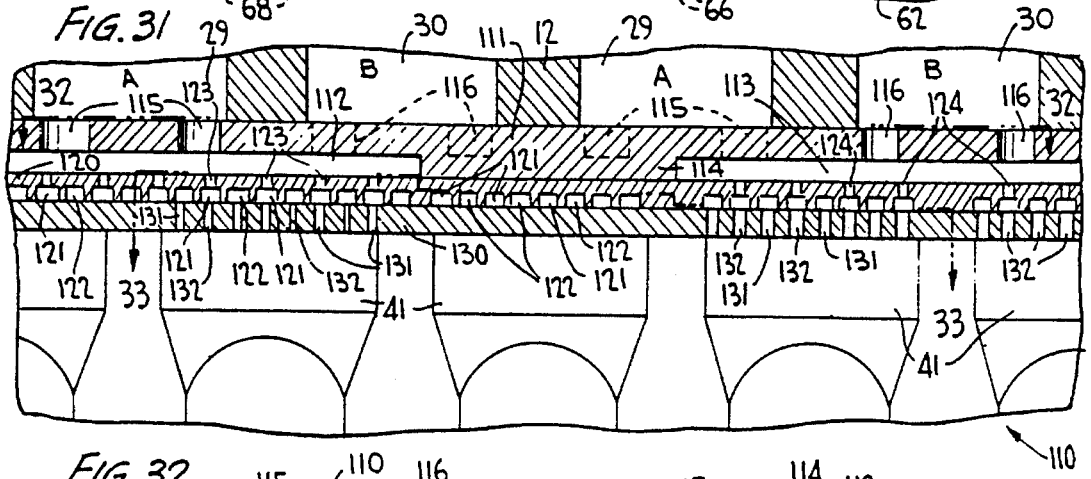
FIG. 31 is a side view in section of a portion of still another spin pack assembly embodiment constructed in accordance with the present invention and viewed along lines 31—31 of FIG. 32.
Figure 32:
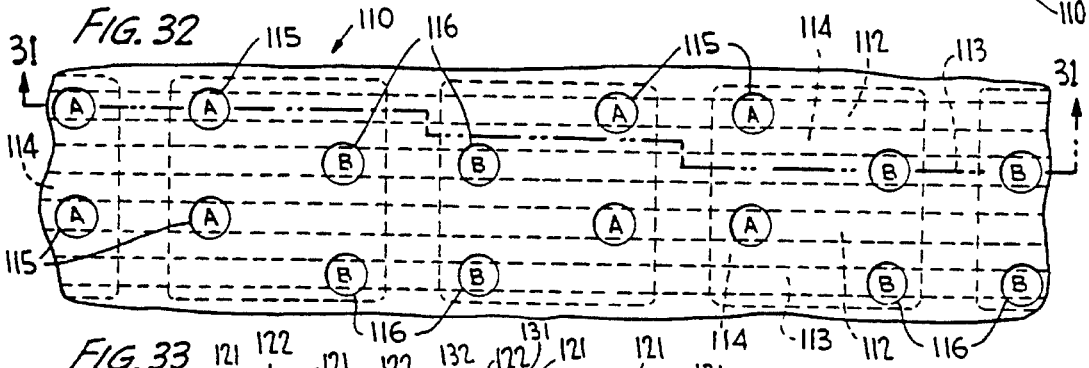
FIG. 32 is a view taken along lines 32—32 of FIG. 31.
Figure 33:
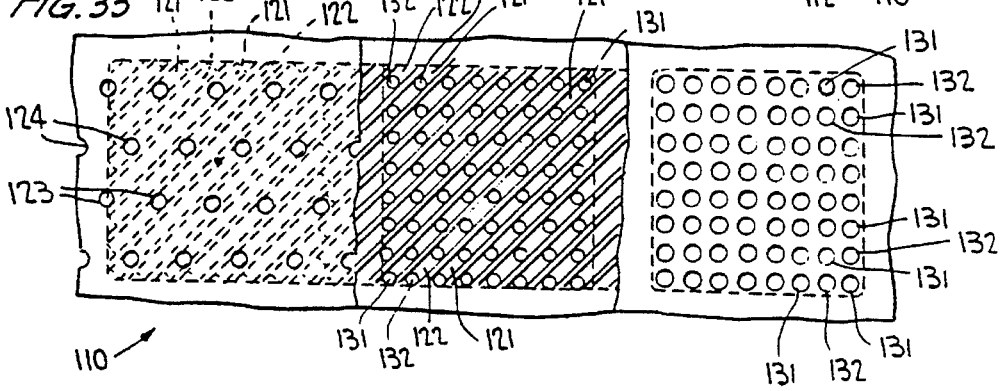
FIG. 33 is a view taken along lines 33—33 of FIG. 31.

The spin pack assembly 110 illustrated in FIGS. 31, 32 and 33 produces multicomponent component fibers of the "matrix" or "island-in-a-sea" type. A bicomponent system is illustrated; however, it is clear that three or more polymer types may be employed within the principles of the invention. Alternate slots 29 and 30 supply polymer components A and B, respectively, from screen supply plate 12 to a first etched distributor plate 111 having multiple A component distribution channels 112 alternating with multiple B component distribution channels 113 etched in its downstream side. The channels 112, 113 extend longitudinally in a direction transversely of the length of slots 29, 30 and successive slots are separated by an un-etched divider rib 114. The upstream side of plate 111 has etched therein alternating rows of A component distribution apertures 115 and B component distribution apertures 116. Each aperture 115 communicates between a respective A component delivery slot 29 and a respective A component channel 112. Each aperture 116 communicates between a respective B component delivery slot 30 and a B component channel 113. Channels 112 and 113, and the rows of apertures 115 and 116, extend substantially along the entire length dimension of the spinneret orifice array.

A second etched distributor plate 120, disposed immediately downstream of plate 111, includes alternating A component distribution channels 121 and B component distribution channels 122 etched in its downstream side and separated by un-etched dividers. In the particular assembly illustrated in FIGS. 31–33, the length dimensions of channels 121 and 122 extend diagonally with respect to channels 112 and 113, and in particular at a 45° angle relative thereto; it will be appreciated, however, that channels 121 and 122 may be oriented at 90° or any other angle other than zero with respect to channels 112 and 113. The upstream side of distributor plate 120 has alternating rows of A component distribution apertures 123 and B component distribution apertures 124 etched through to respective channels 121 and 122. Aperture 123 communicate between the A component channels 112 in plate 111 and channels 121. Apertures 124 communicate between the B component channels 113 in plate 111 and channels 122. Channels 121 and 122 are much narrower than channels 112 and 113 and extend entirely across the spinneret orifice array.

A final distributor plate 130 has arrays of alternating final distribution apertures 13 1 and 132 etched entirely therethrough and in alignment with respective spinneret orifice inlet holes 41. The inlet holes are shown in this embodiment as having square transverse cross-sections; however, round or other cross-sections can be employed, as desired. In the illustrated embodiment, each final distribution aperture array has thirty-two A component apertures 131 interspersed with thirty-two B component apertures 132 such that no two adjacent apertures carry the same polymer component. Each A component aperture 131 registers with one of the A distribution channels 121 in plate 120 so that A component polymer from those channels can be issued in an axial direction into each inlet hole 41 via the thirty-two aligned A component apertures. Similarly, the B component apertures 132 axially direct thirty-two streams of B component polymer from B channels 122 into each spinneret inlet hole 41.

For a spin pack assembly 110 having a rectangular array of spinneret orifices and a usable spinneret face region (i.e., containing spinneret orifices) of 3.5 inches by 21 inches, the following dimensions are typical. Slots 29, 30 are approximately 3.5 inches long; with the slots on 0.200 inch centers, one hundred five slots are utilized. The spinneret plate 15 has orifices 40 on 0.200 inch centers in both directions, yielding approximately seventeen rows of one hundred four orifices, or a total of one thousand seven hundred sixty-eight orifices. Slots 112 and 113 extend the entire twenty-one inch length of the pack assembly and serve to create a set of slots which are much closer together (i.e., 0.040 inches on center) than is possible for the slots in the screen support plate 12. The diagonal slots 121, 122 are even more closely spaced (i.e., on 0.0141 inch centers). The final distribution apertures 131, 132 are etched through-holes located on a 0.200 inch grid, each hole having a 0.010 inch diameter and a center spacing of 0.020 inch.

Figure 34:
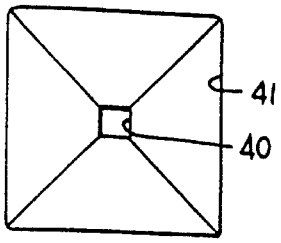
FIG. 34 is a top view in plane of a spinneret orifice that may be employed in the spinneret utilized in any of the embodiments of the present invention.
Figure 38:
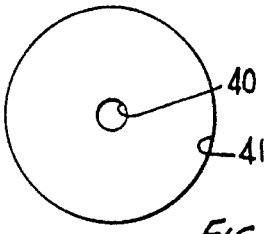
FIG. 38 is a top view in plane of a different spinneret orifice configuration that may be employed in conjunction with the present invention.
Figures 35, 36, 37, 39, 40:
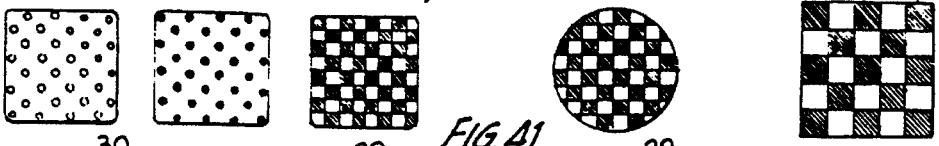
FIGS. 35, 36 and 37 are views in transverse cross-section of multicomponent fibers extruded by individual spinneret orifices in accordance with one aspect of the present invention.
FIGS. 39 and 40 are views in transverse cross-section of still further multicomponent fibers that may be extruded by individual spinneret orifices in accordance with the principles of the present invention.

The inlet holes 41 in spin pack assembly 110 have an entrance chamber in a square shape, probably best formed by electrical discharge machining (EDM). If the two polymer metering pumps are operated at the same speed, polymer components A and B flow through all sixty-four apertures 131, 132 at substantially the same rate, forming a checkerboard pattern corresponding to the type illustrated in FIG. 37. This pattern assumes the square inlet hole configuration, as illustrated in FIG. 34. if the pump for component A is operated at a higher speed, the cross-section appears more like that illustrated in FIG. 35 with islands of B polymer component disposed in a large area "sea" of A polymer component if the B component pump operates at a greater speed, the opposite result occurs and is illustrated in FIG. 36. If it is desired to make the inlet hole 40 round, as illustrated in FIG. 38, a pattern such as that illustrated in FIG. 39 results in the final fiber. The round inlet hole results in fewer final apertures 131, 132 registered with the inlet hole, and therefore fewer discrete polymer streams entering the spinneret orifice. If a fiber such as that illustrated in FIG. 37 is fabricated from two polymers which do not bond strongly to one another, the resulting fiber can be mechanically worked (i.e., drawn, beaten, calendered, etc.) to separate each of the component sub-fibers into sixty-four microfibers. If there are one thousand seven hundred sixty-eight spinning orifices, as assumed above, the total number of micro-fibers would be the product of sixty-four times one thousand seven hundred and sixty-eight, or one hundred thirteen thousand one hundred and fifty-two microfibers produced from the single spin pack assembly. If the drawn checkerboard master fiber has a denier of 6.4 (which is easy to achieve), the micro-fibers would have an average denier of 0.1, very difficult and expensive to make by normal melt spinning. Alternatively, a fiber such as that illustrated in FIGS. 35, 36 might be treated with a solvent which dissolves only the large area "sea" polymer, leaving only thirty-two micro-fibers of the undissolved polymer.

The spacing of spinneret orifices may be increased from 0.200 inch to 0.400 inch in each direction, and square inlet holes 41 of 0.36 inch by 0.36 inch may be employed, under which circumstances a fiber similar to that illustrated in FIG. 37 may be extruded in a matrix of 18×18, or three hundred twenty-four components. The number of spinneret orifices would be reduced by a factor of four to a total of four hundred forty-two; however, these four hundred forty-two orifices, multiplied by the three hundred twenty-four components, yield a total of one hundred forty-three thousand two hundred and eight micro-fibers.

For ordinary denier fibers of the sheath-core and side-by-side component types, spin pack assemblies 60 (FIGS. 19–21; 30) and 70 (FIGS. 11–14) provide excellent results.

Using the same round-hole spinneret, the same pack top, and the same screen support plate, and changing only the intermediate etched distributor plates, it is possible to extrude fibers of the types illustrated in FIGS. 43, 47, 17, 24, 18 and 39. Using a square hole spinneret and the proper intermediate etched distributor plates, fibers as illustrated in FIG. 35, 36, 37 and 40 can be extruded. By changing to a trilobal spinneret, one may extrude fibers of the type illustrated in FIGS. 16, 28 and 29. The same intermediate distributor plates may be employed with spinnerets having different orifice shapes to attain different fiber shapes. Either all, or all but one, of the required distributor plates can be made by the photoetching technique which can be effected very quickly and at relatively low cost. In fact, the cost of the photoetched plates is so low that it is more economical to dispose of them after one use than to clean and inspect them to be sure that all holes are perfectly clean. In contrast, the spin pack assembly of U.S. Pat. No. 4,406,850, designed primarily for sheathcore fibers, can be adapted to make side-by-side component fibers; however, it is necessary to replace the very expensive central distributor plate. For a large rectangular spin pack width of 3.5×21 inches of usable area, a new center plate would be prohibitively expensive as a replacement, and generally a spare plate is required for each spinning position; a staple spinning line normally has ten to forty positions. Changing etched plates cost far less (i.e., on the order of two magnitudes) per type of plate for tooling and initial cost of the disposable plates.

The method, and apparatus of the present invention may also produce very fine fibers, such as the micro-fibers that can be separated in the master ended fibers illustrated in FIGS. 43, 44, 45, 35, 36, 37, 39 and 40. For example, if it is desired to extrude a continuous filament yarn having a total drawn denier of seventy-two, and having one hundred forty-four filaments in the yam bundle (i.e., 0.5 denier per filament), it is possible to spin eighteen filaments of the type illustrated in FIG. 43; the filaments can then be mechanically separated into eight very fine filaments (i.e., micro-fibers), yielding a total of one hundred forty-four micro-fibers.

In all of the various versions of the spin pack assembly of my present invention, it is desirable that the pressure drop across any of the disposable distributor plates be small relative to the total pressure drop from the filter exit to the spinneret exit. This is so because etched plates cannot have the accuracy of passage configuration provided by milling, drilling, reaming, or broaching in the thicker prior an plates. However, any of these machining methods cause the plate to be too expensive to be disposable, especially if the plate has complicated slots. Normally, in fabricating bicomponent fibers of standard denier (e.g., 1.2 to 20), it is quite important to have uniform denier from fiber to fiber, and less important to have uniformity in the proportion of each fiber that is a certain polymer. Uniformity of denier from fiber to fiber will be controlled by the uniformity of total pressure drop through the pack assembly for the polymer going to each orifice. If polymer going to a certain orifice must pass through longer passages or smaller passages than the polymer going to another orifice, the orifice fed by the longer or smaller passages will have less flow of polymer, and therefore will deliver a fiber of lower denier. For example, considering the embodiment illustrated in FIGS. 1–10, the metering plate 13 is shown relatively thick with metering holes or apertures 32, 33 having a relatively large L/D. This is a permanent plate, and the holes would be accurately sized by reaming, broaching, ballizing, etc. Further, the plate thickness could be easily made exactly the same at an points, keeping all of the holes 32, 33 exactly the same length.

It is important that the size of the channels within dams 35, and the holes 36, be large enough so that the pressure drop from the exit of metering apertures 32 to the exit of distribution apertures 36 is small compared to the pressure drop from the entrance to the exit of metering apertures 32. If this is true, metering apertures 32 function to meter the polymer accurately. If the two distribution apertures 36 per channel are close to the same size, each of the two fibers being fed therefrom receive approximately the same mount of core polymer. If, in some other region of the etched plate 14, all of the distribution apertures 36 are generally larger, it will have little effect on uniform distribution so long as the two distribution apertures 36 in any channel defined by a dam 35 are approximately the same. It is in the nature of the etching process for holes to be uniform in a given region, but more variable over a wider area, due to differences in the manner in which the acid impinges upon the plate during the etching process. The B component reservoir formed around the outside of dams 35 has a large area for the B component sheath polymer, so that the pressure drop from the exit of metering apertures 33 to the inlet of distribution apertures 38 should be small. Even though this pressure drop is small it is less for the distribution apertures 38 which are close to a metering aperture 33. For that reason, distribution apertures 38 must be small enough to that the pressure drop through such distribution apertures is greater than the drop in proceeding from metering aperture 33 to distribution aperture 38. However, distribution apertures 38 must be large enough so that the pressure drop through them is not large as compared to the drop through metering apertures 33; otherwise, denier variability increases.

The principles of the present invention apply just as well to a ring-type spin pack assembly as to a rectangular-type assembly. Certain manufacturers prefer the ring-type spin pack assembly and utilize quench air directed transversely of the issued fibers, either radially inward or radially outward, as the fibers leave the spinneret In a typical ring-type spin pack assembly, the inner ring of spinneret orifices might have a circumferential length of twenty-one inches, equivalent to the rectangular spin pack assembly design discussed hereinabove. Spinneret orifices in such an assembly would be disposed in fourteen rings spaced 0.15 inches between rings, and with 3 degrees of arc from hole-to-hole in each ting. This spacing yields one thousand six hundred and eighty spinneret orifices, again similar to the large rectangular pack assembly discussed above. The initial feed slots (e.g., equivalent to slots 29, 30 described above) may be arranged radially, whereby a cross-sectional view would appear quite similar to the illustration presented in FIG. 4 of the accompanying drawings. The filter screens would be annular in configuration. Alternatively, the feed slots 29, 30 may be circumferentially oriented (i.e., annular), whereby the filter screens are ring segments lying above all of the slots. In this configuration, it is desirable to taper the slots (e.g., 29, 30) so that excessive dwell time is not experienced by polymer at the farthest difference from each screen segment.

As noted above, the etching procedure employed in forming the flow distribution paths in the disposable distributor plates permits distribution apertures having ratios L/D of less than 1.5 and, if necessary for some applications, less than 0.7. It is also possible to form distribution channels having depths equal to or less than 0.016 and, if required by certain applications, equal to or less than 0.010 inch. Distribution apertures having lengths less than or equal to 0.020 inch are readily formed by this technique.

As discussed, one method of making the distribution plates of the present invention is by etching. Etching may be done according to known procedures for the metals of the type. EXAMPLE 1 is an exemplary procedure.

EXAMPLE 1

Plate Preparation:

A piece of nickel alloy (42% Ni, 58% Fe) is cut 1" larger in length and width than the finished piece. The sheet is cold rolled with a minimum surface finish of 8 micro inches. The thickness is 0.004–0.060" thick. Thickness tolerance is less than ±0.0003". The sheet is cleaned with an ammonium perchlorate dip then a sulfuric acid dip, rinsed with water and then dried. The plate is laminated on both sides with a 1.3 mill thick negative photo sensitive dry film. Exposure to light prevents the film from being washed away. The film is applied by sandwiching the plate between 2 sheets of film and passing through heat rolls.

Application of Light Mask:

The end result is a clear 0.007" thick sheet of mylar with black spots corresponding to the etched areas on the plate. The black spots are smaller than the finished etched area by the etching depth. (A groove 2 mm wide ×0.25 mm deep with a black line on the mask 1.75 mm wide.) Two (2) masks are prepared, one for the top and one for the bottom. Each mask has identical black spots where a hole is desired. Black lines indicate where a groove is desired. The masks are prepared so that the emulsion will be against the plate. In trade terms: Right-reading-emulsion-down for the top mask, and fight-reading-emulsion-up for the bottom mask.

Masks May Be Computer Generated or Photographic:

a. Computer Generated

A computer drawing of the mask is prepared using a CAD system. The drawing is then printed on 0.007' thick mylar film using a highly accurate laser printer. This printout is the finished mask. This method is preferred due to lowest cost and lead time.

b. Photographic

This method requires drawing the pattern by hand 4–100 times larger than the finished part. The drawing is then photographed. The negative from this picture is then used to make a full size mask using a photo copy camera.

Expose the Photo Resist:

Sandwich the laminated metal plate between the 2 light masks. Shine a light on both sides of the sandwich to expose the photo resist. Unmasked areas will be exposed, chemically changing the photo resist film.

Wash Off Photo Resist:

Wash off the unexposed film in the areas where etching is desired by dipping in a sodium carbonate solution. This solution will not affect the exposed part of the film. Rinse with water and dry. At this point there is a bare metal where etching is desired and a film where no etching is desired.

Etch:

Etching solution (Ferric Chloride Baum 40A) is sprayed on both sides of the plates at 40 psi until the grooves are at a depth of 75% plate thickness. The spray time will vary depending on plate thickness and acid strength. The plate must be alternately sprayed and checked until the proper depth is obtained. The plate is rinsed in water and the remaining photo resist stripped off by immersing in a Potassium Hydroxide solution. Finally, the plate is rinsed with water and dried.

EXAMPLE 2

A spin pack assembly substantially identical to assembly 10 described above in relation to FIGS. 1–10, was tested using a spinneret having seven hundred fifty-six trilobal orifices in conjunction with an etched distributor plate 14 having the same patterns of distribution flow passages illustrated in FIG. 5. The resulting fibers had transverse cross-sections quite similar to that illustrated in FIG. 10. Some fibers (approximately ten to twenty percent) lacked sheath polymer on one of the three fiber lobes. Nearly all fibers had sheath polymer on at least two lobes when sheath and core polymer were fed in a fifty-fifty volume ratio by the two metering pumps. Most initial trials were conducted at 35 MFI polypropylene for both sheath and core, and some color was added to one stream to permit the polymer division to be observed in photomicrographs. Subsequently, this same trilobal sheath/core arrangement was tested utilizing a variety of polymer combinations as represented in Table I. Trials 8, 9, 10 and 11 represented on Table I were made utilizing this particular spin pack assembly. The spinning orifices for the tested spinneret were arranged six millimeters apart in a direction perpendicular to the quench air flow, and 2.1 millimeters apart in the direction parallel to quench air flow. This produced a resulting density of 7.9 orifices per square centimeter of spinneret face area, or 12.6 square millimeters per orifice. With such a density, good fiber quenching requires a strong quench air flow in the first one hundred fifty millimeters below the spinneret, so that the fibers are rendered "stick-free" before they have a chance to fuse together. Using such a quench, it was quite easy to pump 120 cc/min (about 90 gm/min) of polypropylene for sheath and core, giving a total flow of about 0.25 gm/min/orifice. This was the limit of the pumps on the machine utilized for the test, and there was no indication that a higher rate would cause any problem. After optimizing the etching parameters, more than ninety percent of all of the seven hundred fifty-six fibers had sheath material on all three fiber lobes, and one hundred percent had sheath material on at least two holes.

Subsequently, spinnerets, metering plates and etched distributor plates were fabricated to permit spinning concentric round sheath-core fibers on the same overall spin pack assembly. A system with two etched plates was tested in a configuration very much similar to that illustrated in FIGS. 11–14. Metering plate 71 was drilled and reamed and was much thicker than illustrated in FIG. 11. Metering orifices 74, 75 of 0.070 millimeter diameter and 5.0 millimeter length were utilized for more accurate metering of sheath and core polymer to each etched pattern of the etched distributor plates 72, 73. Plate 73, in which the star-shaped final distribution apertures were etched, was approximately 0.25 millimeters thick. The result was a very accurate height channel between the bottom of etched distributor plate 72 and the top of the spinneret plate 15. In order to permit heavier fiber deniers and greater polymer throughput per spinneret orifice, the orifices were spaced further apart than for the trilobal embodiment described above. Spinneret orifices were spaced six millimeters apart in a direction perpendicular to quench air flow, but 5.5 millimeters apart in the direction parallel to quench air flow. This provided a spinneret with two hundred eighty-eight orifices (16 rows of 18 holes) with a thirty-six square millimeter area per orifice, or 2.8 orifices per square centimeter. Utilizing this spin pack assembly, many spinning trials were conducted. Trial numbers 1 through 7 of Table I are typical trials conducted using this unit Trial number 5 had the greatest throughput, about 1.2 gm/min/orifice. This rate was limited by the machine pump size. Even though quench air was utilized only in the first one hundred fifty millimeters below the spinneret, the fiber was not hot at the finish oil application point in all of trials 1–7; a much greater throughput seemed likely. In aH of these runs, the fiber denier uniformity was very good, and the core was quite concentric, yielding a uniform sheath thickness. Some trials were made with only twenty percent sheath polymer by volume, and still all fibers had a sheath which fully surrounded the core. At ten percent sheath polymer by volume, some fibers lacked a full sheath, but no effort was made to correct this problem for purposes of the test

TABLE 1

| | Spinning Trials | | | | | | | | | | |
|---|---|---|---|---|---|---|---|---|---|---|---|
| | Trial Number | | | | | | | | | | |
| Conditions: | 1 | 2 | 3 | 4 | 5 | 6 | 7 | 8 | 9 | 10 | 11 |
| Sheath Polymer | HDPE 8 MFI | PET Coplmr 150 MP | PET Coplmr 200 MP | PP 35 MFI | HDPE 8 MFI | PET Coplmr 130 MP | PET Coplmr 110 MP | Elvax EVA | PE 43 MFI | PP 75 MFI | PP 36 MFI |
| Core Polymer | PET .64 IV | PET .64 IV | PET .64 IV | PET .64 IV | PET .64 IV | PET .64 IV | PET .64 IV | PP 75 MFI | PP 35 MFI | PP 35 MFI | PP 36 MFI |
| % Sheath-Volume | 50 | 50 | 50 | 56 | 36 | 50 | 40 | 10 | 50 | 50 | 50 |
| % Core-Volume | 50 | 50 | 50 | 44 | 64 | 50 | 60 | 90 | 50 | 50 | 50 |
| Sh Melt Temp °C. | 301 | 265 | 299 | 273 | 301 | 254 | 282 | 210 | 241 | 246 | 230 |
| Core Melt Temp °C. | 308 | 305 | 306 | 304 | 315 | 303 | 301 | 210 | 244 | 244 | 230 |
| Sh Flow cc/min | 120 | 120 | 120 | 120 | 117 | 120 | 79 | 13 | 120 | 120 | 120 |
| Core Flow cc/min | 120 | 120 | 120 | 93 | 204 | 120 | 120 | 120 | 120 | 120 | 120 |
| UOY speed m/min | 411 | 411 | 411 | 298 | 411 | 403 | 250 | 60 | 175 | 220 | 220 |
| No. sprt holes | 288 | 288 | 288 | 288 | 288 | 288 | 288 | 756 | 756 | 756 | 756 |
| Spinning Ease | Good | Good | Good | Good | Good | Good | Fair | Poor | Good | Good | Good |
| Qch Air Temp °C. | 18 | 18 | 18 | 18 | 18 | 18 | 18 | 18 | 18 | 18 | 18 |
| Comments | | | | | | | Fibers tacky | Fibers very sticky — run slow only | | | |

The following abbreviations used in Table I have the meanings stated below:
HDPE = high density polyethylene
PET = polyethylene terephthalate polymer
PP = polypropylene
EVA = ethylene vinyl acetate copolymer
PE = polyethylene
MP = melting point (in degrees C.)
MFI = melt flow index (viscosity index for olefin polymers)
IV = intrinsic viscosity
C. = Celsius
cc = cubic centimeters
Sh = sheath From the foregoing description, it will be appreciated that the invention makes available a novel method and apparatus for fabricating profiled multi-component fibers. The apparatus permits different types of multi-component fibers such as sheath-core fibers with ordinary denier (e.g., 2 to 40), side-by-side fibers with ordinary denier, fibers having complex polymer component arrangements add ordinary denier, very fine fibers (e.g., 0.3 to 2 drawn denier) and micro-fibers (denier below 0.3). Addition, the method and apparatus results in high productivity, low initial cost, low maintenance cost, the flexibility of fabricating different polymer arrangements without having to purchase costly parts, and ability to produce fibers of uniform denier and shape.

Having described preferred embodiments of a new and improved method and apparatus for making profiled multi-component fibers in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A process for manufacturing a flow distribution plate for use in the melt spinning of fibers comprising etching distribution flow paths in at least one surface of said flow distribution plate in a pattern which feeds mutually separated polymer components to each inlet hole of an array of multiple spinneret orifices.

* * * * *